US007318584B2

(12) United States Patent
Kato et al.

(10) Patent No.: US 7,318,584 B2
(45) Date of Patent: Jan. 15, 2008

(54) SHEET PROCESSING APPARATUS AND IMAGE FORMING APPARATUS

(75) Inventors: Hitoshi Kato, Ibaraki (JP); Wataru Kawata, Chiba (JP)

(73) Assignee: Canon Kabushiki Kaisha (JP)

( * ) Notice: Subject to any disclaimer, the term of this patent is extended or adjusted under 35 U.S.C. 154(b) by 379 days.

(21) Appl. No.: 10/610,507

(22) Filed: Jun. 30, 2003

(65) Prior Publication Data

US 2004/0051228 A1 Mar. 18, 2004

(30) Foreign Application Priority Data

Jun. 28, 2002 (JP) ..... 2002-189924

(51) Int. Cl.
*B65H 33/04* (2006.01)

(52) U.S. Cl. ..... 270/58.11; 270/207; 270/58.12; 270/58.08; 270/58.17

(58) Field of Classification Search ..... 271/207, 271/220, 241; 270/58.11, 58.12, 58.08, 58.17
See application file for complete search history.

(56) References Cited

U.S. PATENT DOCUMENTS

| | | | | |
|---|---|---|---|---|
| 4,938,657 | A | 7/1990 | Benson et al. | 414/790.4 |
| 5,826,158 | A * | 10/1998 | Hirano et al. | 399/410 |
| 6,142,461 | A * | 11/2000 | Asao et al. | 270/58.09 |
| 6,283,470 | B1 | 9/2001 | Hirai | 271/189 |
| 6,354,059 | B1 | 3/2002 | Yoshie et al. | 53/117 |
| 6,450,492 | B1 * | 9/2002 | Coombs et al. | 270/58.08 |
| 6,450,934 | B1 * | 9/2002 | Coombs | 493/383 |
| 6,517,065 | B2 | 2/2003 | Miyake et al. | |
| 6,702,279 | B2 * | 3/2004 | Adachi et al. | 271/220 |
| 2001/0052666 | A1 | 12/2001 | Kuwata et al. | 271/3.01 |
| 2002/0163119 | A1 * | 11/2002 | Kawata | 271/207 |

FOREIGN PATENT DOCUMENTS

| | | | |
|---|---|---|---|
| GB | 857871 A | | 1/1961 |
| JP | 2001-89009 | * | 4/2001 |
| JP | 2003-81517 | * | 3/2003 |

* cited by examiner

*Primary Examiner*—Patrick Mackey
*Assistant Examiner*—Thomas Morrison
(74) *Attorney, Agent, or Firm*—Rossi, Kimms & McDowell, LLP

(57) ABSTRACT

There is provided a sheet processing apparatus that is capable of allowing a decrease in the speed at which sheets are discharged to a stacking device even if sheets are conveyed into the sheet processing apparatus at short time intervals, or capable of eliminating the necessity of using an aligning device that can perform each alignment at a high speed, or capable of reducing the number of times of operations to be performed by the aligning device, and an image forming apparatus that is provided with the sheet processing apparatus. A plurality of sheets being conveyed is superposed. The sheets conveyed from the sheet superposing device are stacked. The sheets stacked in the stacking device are aligned. A sheet superposing device superposes a plurality of sheets being conveyed. A stacking device stacks thereon the sheets conveyed from said sheet superposing device are stacked. An aligning device aligns the sheets stacked in said stacking device. A controller that causes said sheet superposing device to perform a sheet superposing operation irrespective of a sheet bundle as a unit to be processed by the sheet processing apparatus.

9 Claims, 18 Drawing Sheets

TWO-PAGE ORIGINALS (EXAMPLE OF TROUBLE)

TWO-PAGE ORIGINALS

SEVEN-PAGE ORIGINALS (EXAMPLE OF TROUBLE)

SEVEN-PAGE ORIGINALS

SEVEN-PAGE ORIGINALS (SECOND EMBODIMENT)

SEVEN-PAGE ORIGINALS

SEVEN-PAGE ORIGINALS
(WHEN NUMBER OF SHEETS IN BUNDLE IS KNOWN)

SIX-PAGE ORIGINALS
(WHEN NUMBER OF SHEETS IN BUNDLE IS KNOWN)

SEVEN-PAGE ORIGIINALS
(WHEN NUMBER OF SHEETS IN BUNDLE IS KNOWN)
(FOURTH EMBODIMENT)

SHEET PROCESSING APPARATUS AND IMAGE FORMING APPARATUS

BACKGROUND OF THE INVENTION

1. Field of the Invention

The present invention relates to a sheet processing apparatus including an aligning device that aligns sheets stacked in a stacking device, and an image forming apparatus provided with the sheet processing apparatus.

2. Description of the Related Art

Conventionally, a sheet processing apparatus has been proposed which discharges sheets sheet by sheet conveyed from an image forming apparatus such as a copying machine or a printer onto a processing tray by a discharging device, aligns the sheets using aligning plates each time one sheet is discharged onto the processing tray, staples a bundle of sheets of one copy when they have been discharged onto the processing tray, and discharges the bundle of sheets onto a stack tray via a pair of bundle discharging rollers.

However, assuming that an image forming apparatus is used which discharges sheets at a higher speed and at shorter time intervals (i.e., shorter sheet conveyance time intervals) than a conventional image forming apparatus, in order to improve the productivity, there is a limitation on a period of time required for sheet alignment such that a sheet is discharged onto thee processing tray before alignment of a preceding sheet is completed. For this reason, the sheet conveyance intervals must be extended, which lowers the productivity of the image forming apparatus.

Also, when sheets are simply discharged onto a discharged sheet tray, if the sheet conveying speed is reduced in the sheet processing apparatus in the case where sheets are conveyed at a high speed and at short intervals, a sheet is discharged onto the tray while a preceding sheet is being aligned, and hence it is impossible to reduce the sheet conveying speed so as to adjust the sheet jumping amount (the degree to which a discharge. Therefore, reliable sheet alignment cannot be realized, and the productivity of the image forming apparatus can be deteriorated due to increase in sheet conveyance time intervals.

Further, if a motor which enables high-speed sheet alignment is adopted so as to convey sheets at a high speed and at short intervals and align the sheets each time one sheet is discharged onto the processing tray, the cost and the size of the motor will increase.

SUMMARY OF THE INVENTION

It is an object of the present invention to provide a sheet processing apparatus that is capable of allowing a decrease in the speed at which sheets are discharged to a stacking device even if sheets are conveyed into the sheet processing apparatus at short time intervals, or capable of eliminating the necessity of using an aligning device that can perform each alignment at a high speed, or capable of reducing the number of times of operations to be performed by the aligning device, and an image forming apparatus that is provided with the sheet processing apparatus.

To attain the above object, in a first aspect of the present invention, there is provided a sheet processing apparatus comprising a sheet superposing device that superposes a plurality of sheets being conveyed, a stacking device that stacks thereon the sheets conveyed from the sheet superposing device are stacked, an aligning device that aligns the sheets stacked in the stacking device, and a controller that causes the sheet superposing device to perform a sheet superposing operation irrespective of a sheet bundle as a unit to be processed by the sheet processing apparatus.

Preferably, in the first aspect, the controller causes the sheet superposing device to superpose sheets constituting the sheet group at least two by two each time until a sheet preceding by N sheets a last sheet of the sheets constituting the sheet group, reaches the sheet superposing device.

Further, in the first aspect, the controller is operable when a preceding sheet exists in the sheet superposing device at a time point the sheet preceding by N sheets the last sheet of the sheets constituting the sheet bundle reaches the sheet superposing device, for causing the sheet superposing device to superpose the sheet preceding by N sheets the last sheet and the preceding sheet existing in the sheet superposing device, the controller is operable when no preceding sheet exists in the sheet superposing device at a time point the sheet preceding by N sheets the last sheet constituting the sheet bundle reaches the sheet superposing device, for causing the sheet superposing device to superpose the sheet preceding by N sheets the last sheet and a succeeding sheet.

Still further, in the first aspect, N is equal to any numerical value within a range from 2 to a value which is one smaller than the maximum number of sheets that can be superposed by the sheet superposing device.

Preferably, in the first aspect, the controller causes the sheet superposing device to superpose a first sheet of sheets constituting the sheet bundle, that is discharged into the stacking device and a succeeding sheet of the sheets constituting the sheet bundle.

Preferably, in the first aspect, the controller causes the sheet superposing device to superpose sheets constituting the sheet group at least two by two each time until a sheet immediately preceding a last sheet of the sheets constituting the sheet bundle reaches the sheet superposing device, and the controller causes the sheet superposing device to always superpose the sheet immediately preceding the last sheet and the last sheet.

Further, in the first aspect, the number of sheets to be superposed each time is one smaller than the maximum number of sheets to be superposed by the sheet superposing device.

Preferably, in the first aspect, comprising a bundle discharging device that discharges in a bundle the sheets stacked in the stacking device.

To attain the above object, in a second aspect of the present invention, there is provided an image forming apparatus that is provided with a sheet processing apparatus according to claim 1.

To attain the above object, in a third aspect of the present invention, there is provided a sheet processing apparatus comprising a sheet superposing device that superposes a plurality of sheets being conveyed, a stacking device that stacks thereon the sheets conveyed from the sheet superposing device are stacked, an aligning device that aligns the sheets stacked in the stacking device, and a controller operable when the aligning device performs an aligning operation, for causing the sheet superposing device to superpose the sheets such that conveyance time intervals between the sheets being conveyed to the stacking device are wider than conveyance time intervals between the sheets being received by the sheet processing apparatus.

The above and other objects, features, and advantages of the invention will become more apparent from the following detailed description taken in conjunction with the accompanying drawings.

DETAILED DESCRIPTION OF THE PREFERRED EMBODIMENTS

Figure 1:
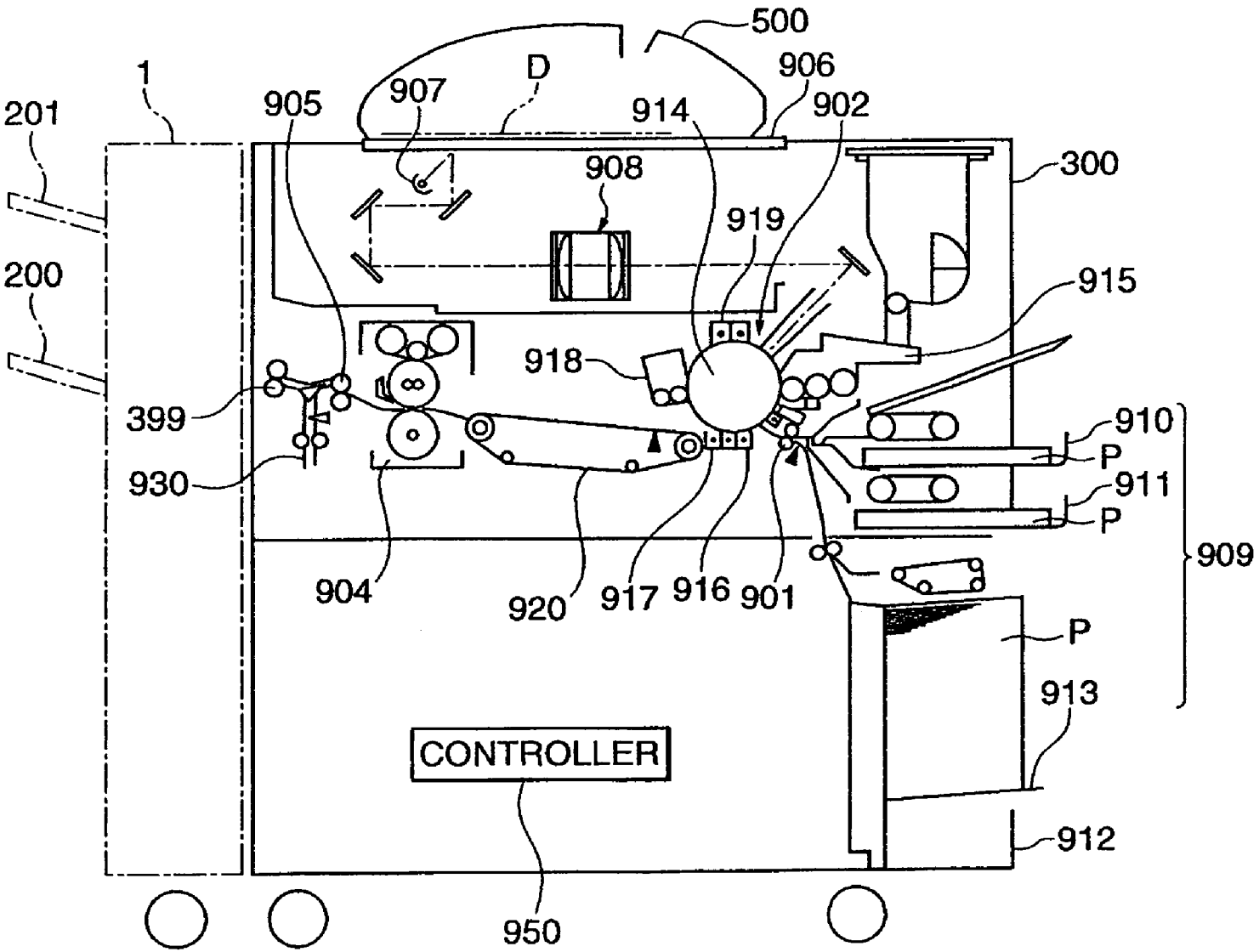
FIG. 1 is a view showing the internal construction of at image forming apparatus to which a sheet processing apparatus according to an embodiment of the present invention is applied.

The present invention will now be described in detail with reference to the drawing showing preferred embodiments thereof.

A description will now be given of a first embodiment of the present invention.

According to the present embodiment, a sheet processing apparatus attached to an image forming apparatus superposes at least two sheets in a sheet superposing device, and then discharges them to a stacking device via a discharging device, thus enabling alignment of sheets to be completed within sheet conveyance time intervals that are determined in dependence on the productivity of the main body of the image forming apparatus. Also, since the sheet processing apparatus superposes at least two sheets in the sheet superposing device, and then discharges them to the stacking device via the discharging device, the sheet conveying speed can be controlled to be reduced at sheet conveyance time intervals that are determined in dependence on the productivity of the main body of the image forming apparatus.

Specifically, by superposing at least two sheets and then discharging them to the stacking device via the discharging device, the number of times of operation performed by an aligning device that aligns sheets discharged into the sheet stacking device can be reduced, and the conveyance time intervals between sheets being discharged into the sheet stacking device can be increased, whereby the sheet processing apparatus with a high alignment latitude and the image forming apparatus having the sheet processing apparatus are realized.

FIG. 1 is a view showing the internal construction of the image forming apparatus to which the sheet processing apparatus according to the present embodiment is applied. The sheet processing apparatus is adapted to be incorporated into not only a copying machine as the image forming apparatus but also the main body of another image forming apparatus such as a printer, a facsimile, or a multi-function machine. Thus, the sheet processing apparatus according to the present embodiment should not necessarily be incorporated into the main body of a copying machine.

An image forming apparatus main body (copying machine main body) 300 is comprised mainly of a platen glass 906 on which an original is to be placed, a light source 907 that illuminates the original, a lens system 908 that leads the reflected light from the original, a sheet feeding section 909 that stores and feeds sheets, an image forming section 902 that forms an image on a sheet, and a controller 950 that controls the component parts of the image forming apparatus. Further, an automatic original feeder (RDF) 500 that feeds an original to the platen glass 906 is attached to an upper part of the image forming apparatus main body 300, and a sheet processing apparatus 1 that stacks sheets with images formed thereon discharged from the image forming apparatus main body 300 is attached to a side of the image forming apparatus main body 300.

The sheet feeding section 909 is provided with cassettes 910 and 911, which are detachably attached to the image forming apparatus main body 300 to store sheets P for use in recording (image formation), and a deck 913, which is disposed on a pedestal 912 of the image forming apparatus main body 300 to store sheets P for use in recording (image formation). The image forming section 902 is comprised of a cylindrical photosensitive drum 914, a developing unit 915 that develops an electrostatic latent image formed on the photosensitive drum 914, a transfer electrifier 916 that transfers a toner image onto a sheet P, a separation electrifier 917, a cleaner 918 that removes residual toner from the photosensitive drum 914, a primary electrifier 919, and so forth. The developing unit 915, the transfer electrifier 916, the separation electrifier 917, the cleaner 918, and the primary electrifier 919 are arranged around the photosensitive drum 914. Arranged downstream of the image forming section 902 are a conveying device 920 that conveys a sheet P with a toner image formed thereon, a fixing device 904 that fixes a toner image formed on a conveyed sheet P, a pair of discharge rollers 905 that discharge a sheet P with a toner image formed and fixed thereon, and so forth.

A description will now be given of the operation of the image forming apparatus main body 300. In response to a sheet feed signal outputted from the controller 950 provided in the image forming apparatus main body 300, a sheet P is fed from the cassette 910 or 911 or from the deck 913. On the other hand, light emitted from the light source 907 and reflected on an original D placed on the platen glass 906 is irradiated upon the photosensitive drum 914 of the image forming section 902 via the lens system 908. The photosensitive drum 914 is electrified in advance by the primary electrifier 919. The irradiation of light forms an electrostatic latent image on the photosensitive drum 914, and the electrostatic latent image is developed as a toner image on the photosensitive drum 914 by the developing unit 915.

The sheet P fed from the sheet feeding section 909 is corrected for skewing by the resist rollers 901, and then conveyed to the image forming section 902 with timing being controlled. In the image forming section 902, the toner image on the photosensitive drum 914 is transferred onto the conveyed sheet P by the transfer electrifier 916, and the sheet P with the toner image transferred thereto is electrified to be in reverse polarity to the polarity of the transfer electrifier 916 by the separation electrifier 917, and separated from the photosensitive drum 914. The separated sheet P is then conveyed to the fixing device 904 by the conveying device 920, so that the transferred image is permanently fixed on the sheet P by the fixing device 904. The sheet P with the image fixed thereon is discharged from the image forming apparatus main body 300 by the pair of discharge rollers 905 in a straight sheet discharge mode in which the sheet P is conveyed with a surface thereof on which the image is formed facing upward, or in an inversion sheet discharge mode in which the sheet P is conveyed to a sheet inversion path 930 after an image is fixed thereon and inverted so that the sheet P can be conveyed with a surface thereof on which the image is formed facing downward. In this way, an image is formed on a sheet P fed from the sheet feeding section 909, and the sheet P with the image formed thereon is discharged into the sheet processing apparatus 1.

Figure 2:
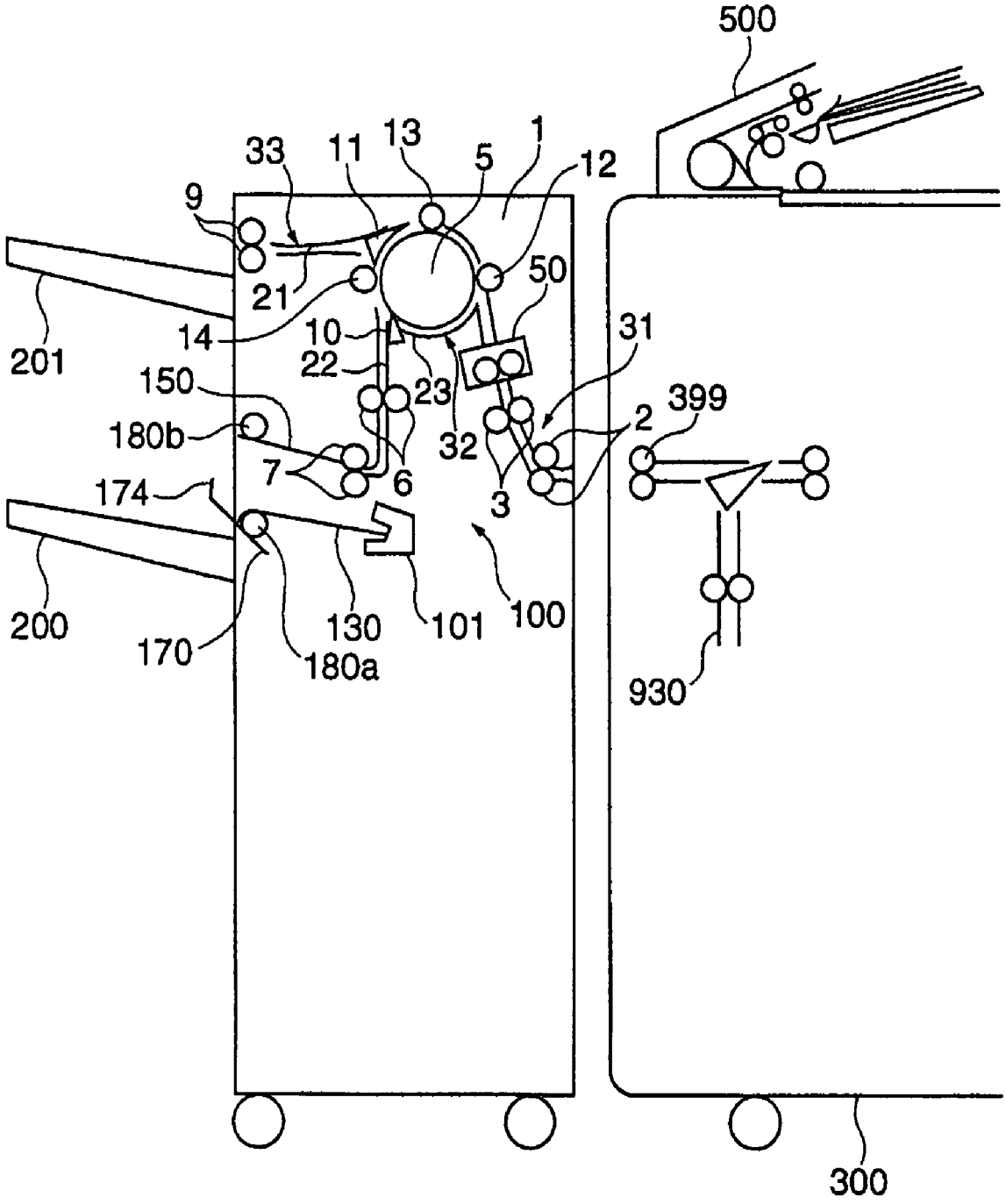
FIG. 2 is a view showing the entire construction of the sheet processing apparatus in FIG. 1.

A description will now be given of the construction of the sheet processing apparatus (finisher) 1 attached to the image forming apparatus main body 300. FIG. 2 is a view showing the entire construction of the sheet processing apparatus 1 in FIG. 1. Detailed description of the image forming apparatus main body 300 and the automatic original feeder (RDF) 500 is omitted here. In the image forming apparatus main body 300, a pair of discharge rollers 399 discharge a sheet with an image formed thereon into the sheet processing apparatus 1. In the sheet processing apparatus 1, a pair of inlet rollers 2 capture a sheet discharged from the image forming apparatus main body 300, and a pair of conveying rollers 3 convey the sheet. An inlet sensor 31 detects the presence of a sheet. A punch unit 50 is operable to punch the conveyed sheet near a trailing end. A large conveying roller (hereinafter referred to as "the buffer roller") 5 is capable of pressing the sheet with its pressing rollers 12, 13, and 14, winding a plurality of sheets on a roller surface thereof, and conveying the wound sheets so as to discharge them.

A switching flapper 11 switches the path between a non-sort path 21 and a sort path 22. A switching flapper 10 switches the path between the sort path 22 and a buffer path 23 on which a sheet is temporarily retained. A pair of conveying rollers 6 convey a sheet from the buffer roller 5. An intermediate tray (hereinafter referred to as "the processing tray") 130 is intended to temporarily collect sheets, and align and staple them. A pair of discharge rollers 7 discharge a sheet onto the processing tray 130. The processing tray 130 is equipped with a leading end abutment member 174 on which the leading end of a sheet discharged onto the processing tray 130 is to be abutted. The leading end abutment member 174 selectively assumes a projecting position where the discharged sheet is abutted in the state of being projected from a stacking surface of the processing tray 130, and a receding position outside the stacking surface, and is capable of moving in the sheet conveying direction so as to align sheets.

A rocking guide 150 is capable of rocking between an open position and a closed position via a rocking fulcrum shaft, described later. A bundle discharge upper roller **180*b* is supported by the rocking guide 150, and cooperates with a bundle discharge lower roller 180*a* disposed on the processing tray 130 to convey a bundle of sheets on the processing tray 130 and discharge the bundle of sheets onto a stack tray 200 when the rocking guide 150 assumes the closed position. Thus, the bundle discharge lower roller 180*a* and the bundle discharge upper roller 180*b* cooperate to constitute a pair of sheet bundle discharge rollers, which are intended to discharge a bundle of sheets on the processing tray 130 onto the stack tray 200. Note that in FIG. 2, reference numeral 9 denotes discharge rollers, and reference numerals 32 and 33** denote pass sensors.

A description will now be given of a processing tray unit 129 in the sheet processing apparatus 1 with reference to FIG. 3. The processing tray unit 129 is disposed between a conveying section that conveys a sheet discharged from the image forming apparatus main body 300, and the stack tray 200 that receives and stores a bundle of sheets processed by the processing tray 130. The processing tray unit 129 is comprised of the processing tray 130, a trailing end stopper 131, an aligning device 140, the rocking guide 150, a pull-in paddle 160, a retractable tray 170, and the pair of bundle discharge rollers **180*a* and 180*b***.

The processing tray 130 is disposed with a downstream side (the left side as viewed in FIG. 3) thereof in the sheet conveying direction being directed upward and an upstream side (the right side as viewed in FIG. 3) thereof in the sheet conveying direction being directed downward, and more specifically, the processing tray 130 is inclined such that the downstream side thereof in the sheet conveying direction is higher. The above-mentioned trailing end stopper 131 is engaged with an end of the lower part of the processing tray 130. It should be noted that the processing tray 130 may be inclined such that the downstream side thereof in the sheet conveying direction is lower. A sheet P discharged via a pair of discharge rollers of the conveying section slides on the processing tray 130 until a trailing end of the sheet P thereof abuts on the trailing end stopper 131 due to its own weight and the action of the pull-in paddle 160. The bundle discharge lower roller, **180*a* is attached to an end of the upper part of the processing tray 130, and the bundle discharge upper roller 180*b* that is to abut on the bundle discharge lower roller 180*a* is attached to the rocking guide 150, described later. The bundle discharge rollers 180*a* and 180*b* are capable of being rotated forward and backward by a bundle discharge motor M180**.

A description will now be given of the aligning device 140 including the processing tray 130 and an aligning wall moving mechanism with reference to FIG. 4 as viewed from an arrow c in FIG. 3. Aligning members 141 and 142 of the aligning device 140 are arranged at the front and at the rear, respectively, and are capable of moving back and forth independently of each other. Both the front aligning member 141 and the rear aligning member 142 are erected on the processing tray 130, and are vertically bent from aligning surfaces **141*a* and 142*a* that press the side edges of the sheet P. The front aligning member 141 and the rear aligning member 142 are comprised of respective supporting surfaces that support the lower surface of the sheet P, and rack gear sections 141*b* and 142*b*, respectively, which are arranged in parallel with the processing tray 130 and in which rack gears are engraved. The two aligning members 141 and 142 are each supported by a guide that extends in the longitudinal direction of the processing tray 130, and constructed such that the aligning surfaces 141***a* and 142*a* are projected from an upper surface of the processing tray 130 and the gear sections 141*b* and 142*b* are projected from a lower surface of the processing tray 130.

Pinion gears 143 and 144 are engaged with the rack gear sections 141*b* and 142*b*, respectively, and are connected to motors M141 and M142 via pulleys and belts. Normal and reverse rotations of the motors M141 and M142 move the aligning members 141 and 142 forward and backward. The aligning members 141 and 142 are each provided with a sensor, not shown, which detects the. aligning member 141 or 142 being located at a home position thereof, and the aligning members 141 and 142 are normally on standby at the home position. In the, present embodiment, the home position of the front aligning member 141 is set at the foremost position as viewed in FIG. 4, i.e. the position closest to a side edge of the sheet and the home position of the rear aligning member 142 is set at the rearmost position as viewed in FIG. 4, i.e. a position closest to the opposite side edge of the sheet.

Figure 3:
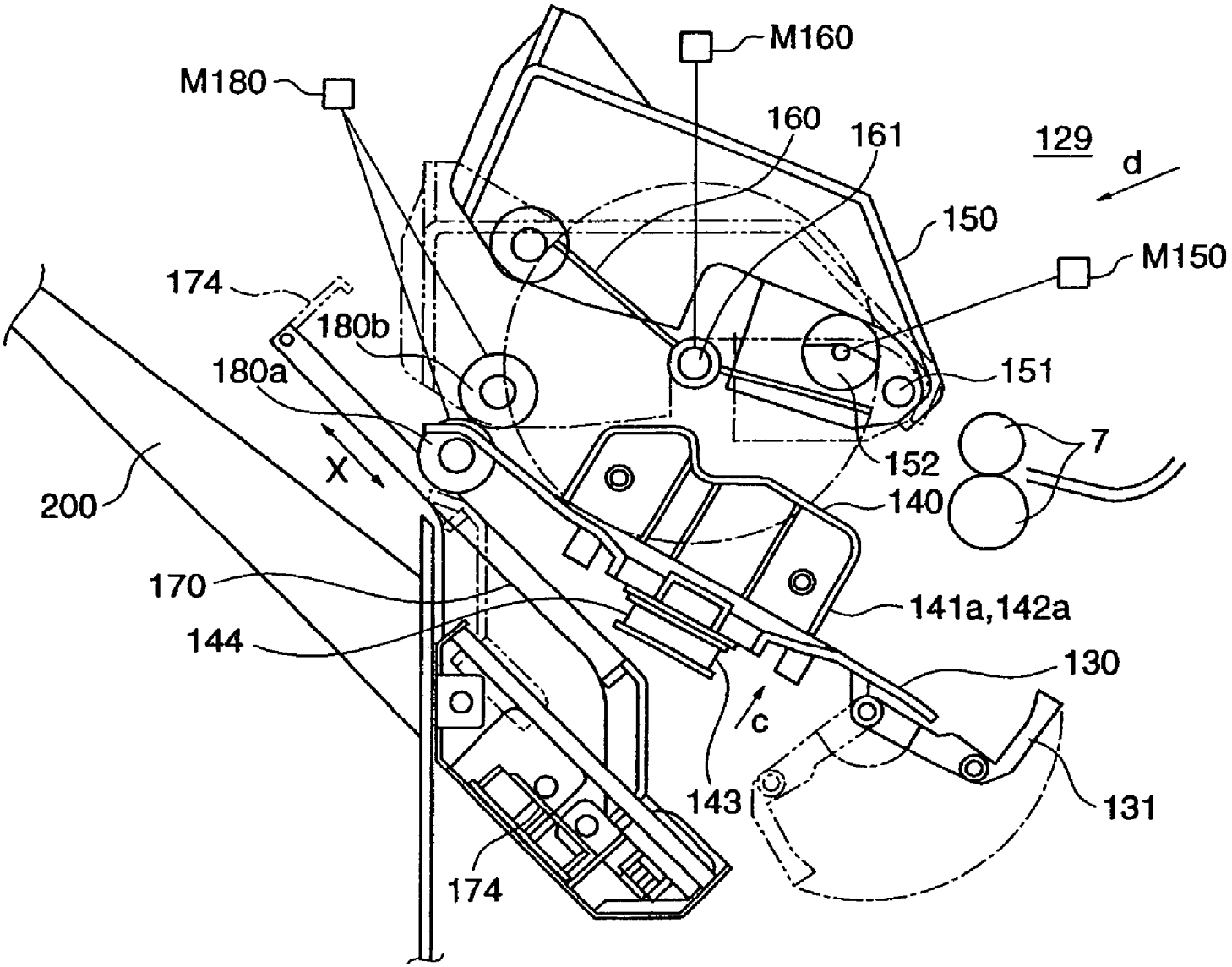
FIG. 3 is a longitudinal sectional side view showing a rocking guide and a processing tray appearing in FIG. 2.
Figure 4:
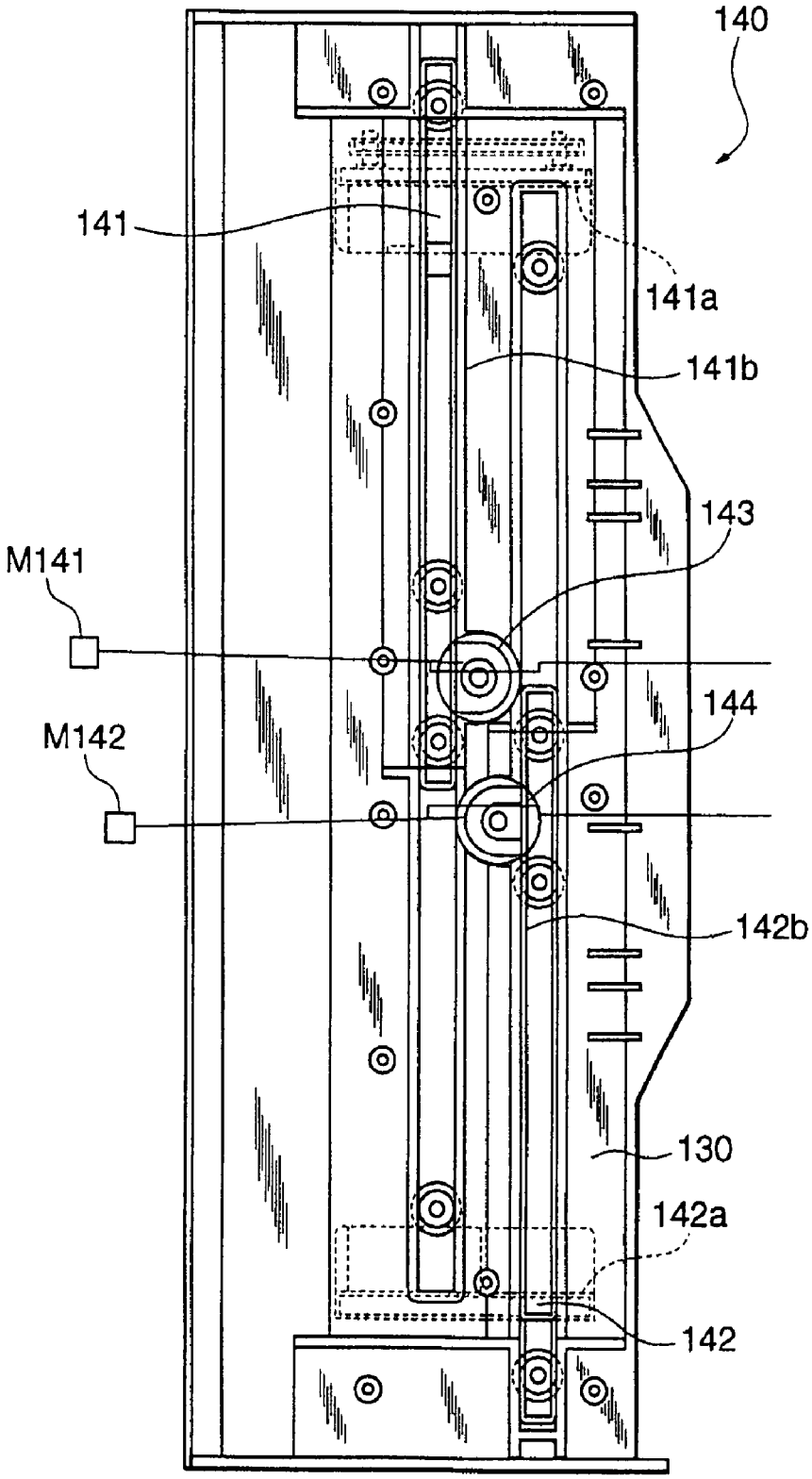
FIG. 4 is a plan view showing an aligning device appearing in FIG. 3.

As shown in FIG. 3, the rocking guide 150 supports the bundle discharge upper roller 180*b* at a downstream part thereof (the left side as viewed in FIG. 3), and is provided with the rocking fulcrum shaft 151 at an upstream part thereof (the right side as viewed in FIG. 3). Normally, the rocking guide 150 is in an open position indicated by the solid lines in FIG. 3 in which the bundle discharge rollers 180*a* and 180*b* are spaced from each other when sheets P are discharged one by one onto the processing tray 130, and hence the rocking guide 150 never obstructs an aligning action in which the sheets P are discharged onto the processing tray 130 and aligned. When a bundle of sheets P is discharged from the processing tray 130 onto the stack tray 200, the rocking guide 150 is brought into a closed position indicated by the two-dot chain lines in FIG. 3 in which the bundle discharge rollers 180*a* and 180*b* are abutted on each other.

A rotary cam 152 is disposed at a position corresponding to a side of the rocking guide 150. When the rotary cam 152 rotates to push up the side of the rocking guide 150, the rocking guide 150 is brought into the open position while rocking about the rocking fulcrum shaft 151, and when the rotary cam 152 has rotated through an angle of 180° to be spaced from the side of the rocking guide 150, the rocking guide 150 is brought into the closed position. The rotary cam 152 is rotatively driven by a rocking guide motor M150 connected to the rotary cam 152 via a driving system, not shown. Further, the open position of the rocking guide 150 is the home position, and is provided with a sensor, not shown, that detects the home position.

A description will now be given of the pull-in paddle 160. As shown in FIG. 3, the pull-in paddle 160 is fixed on a paddle shaft 161, which is rotatably supported on longitudinal side plates, and is connected to a paddle motor M160 to be rotated counterclockwise as viewed in FIG. 3 by the paddle motor M160. The length of the pull-in paddle 160 is set to be slightly greater than the distance between the paddle 160 and the processing tray 130, and the home position of the pull-in paddle 160 is set at a position (the solid lines in FIG. 3) where the pull-in paddle 160 never abuts on a sheet P discharged onto the processing tray 130 via the pair of discharge rollers. In this state, when the discharge of the sheet P is completed and the sheet P falls upon the processing tray 130, the pull-in paddle 160 is rotatively driven counterclockwise as viewed in FIG. 3 by the rocking guide motor M150 to pull the sheet P until the sheet P abuts on the trailing end stopper 131. Thereafter, upon the lapse of a predetermined period of time, the pull-in paddle 160 returns to and stops at its home position to prepare for the next sheet discharge.

Figure 5:
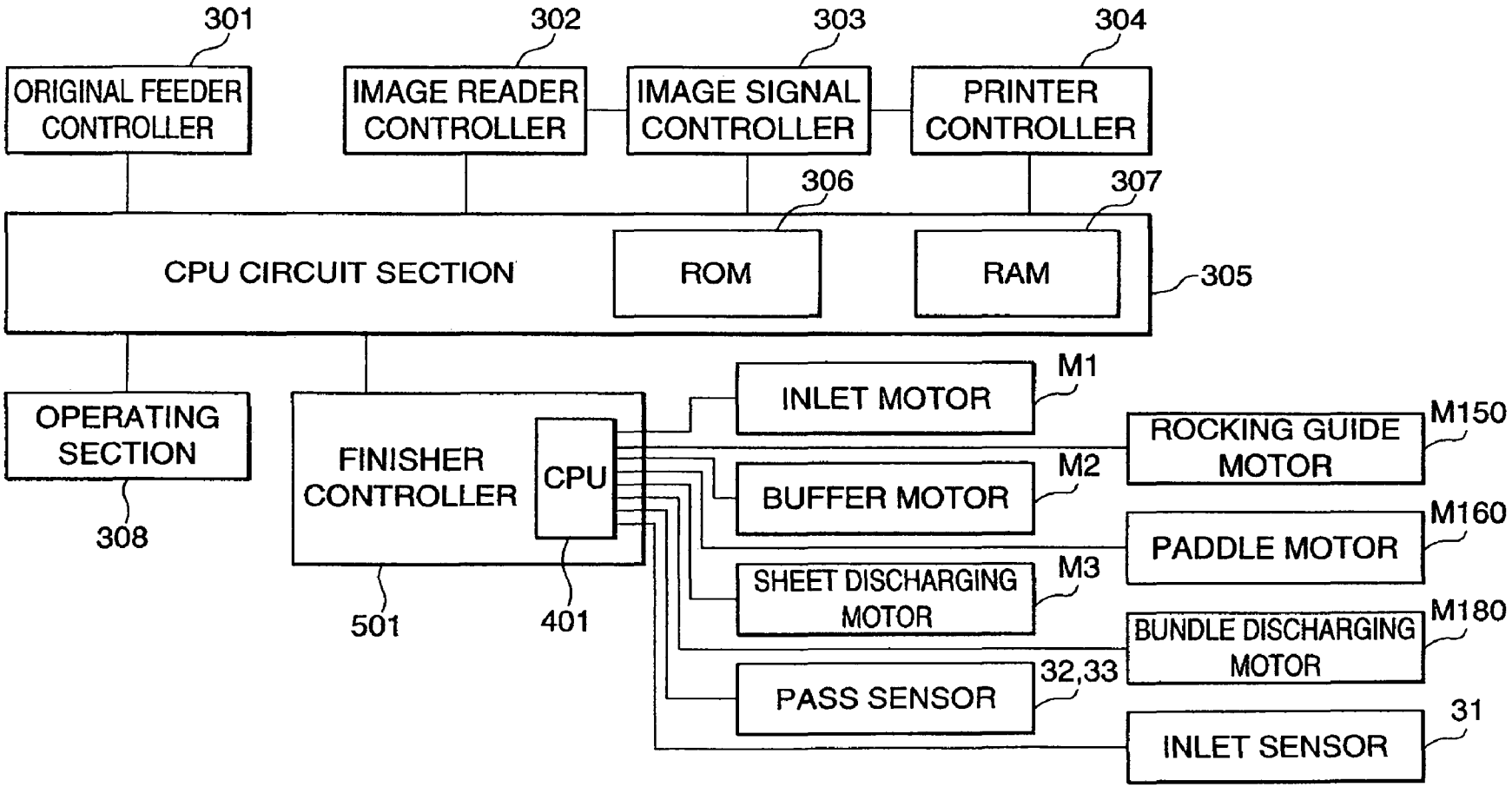
FIG. 5 is a block diagram showing the construction of a controller of the image forming apparatus in FIG. 1.

A description will now be given of the controller 950 that controls the overall operations of the image forming apparatus with reference to FIG. 5. FIG. 5 is a block diagram showing the construction of the controller 950 of the image forming apparatus appearing in FIG. 1. As shown in FIG. 5, the controller 950 is comprised of a CPU circuit section 305, an original feeder controller 301, an image reader controller 302, an image signal controller 303, a printer controller 304, and a finisher controller 501. The CPU circuit section 305 has a CPU, not shown, a ROM 306, and a RAM 307 incorporated therein, and collectively controls the original feeder controller 301, the image reader controller 302, the image signal controller 303, the printer controller 304, an operating section 308, and the finisher controller 501 according to control programs stored in the ROM 306. The RAM 307 temporarily stores control data, and serves as a work area for operations performed for control.

The original feeder controller 301 provides control to drive the automatic original feeder 500 according to an instruction from the CPU circuit section 305. The image reader controller 302 provides control to drive the above-mentioned light source 907, lens system 908, and so forth, and transfers an RGB analog image signal outputted from the lens system 908 to the image signal controller 303. The image signal controller 303 converts the RGB analog image signal, transferred from the lens system 908 into a digital signal, performs various processing on the digital signal, and converts the digital signal into a video signal and outputs the video sign alto the printer controller 304. The image signal controller 303 performs processing under the control of the CPU circuit section 305. The printer controller 304 controls image formation carried out by the image forming apparatus main body 300.

The operating section 308 is comprised of a plurality of keys for setting various functions relating to image formation, a display section for displaying information indicative of settings, and so forth, and outputs a key signal according to operation of each key to the CPU circuit section 305 and displays information on the display section according to a signal transmitted from the CPU circuit section 305. The finisher controller 501 is provided in the sheet processing apparatus 1, and exchanges information with the CPU circuit section 305 via a communication IC (IPC), not shown, to drive the entire sheet processing apparatus 1. The finisher controller 501 includes a CPU 401, a winding counter, a buffer passage counter, and a discharge counter, all of which will be described later, and performs processing shown in flow charts, referred to later, according to programs stored in a ROM, not shown. A variety of actuators such as the inlet motor M1, the buffer motor M2, and the sheet discharge motor M3, and a variety of sensors such as the inlet sensor 31 and the pass sensors 32 and 33 are connected to the CPU 401. The inlet motor M1 drives the inlet rollers 2 and the conveying rollers 3, the buffer motor M2 drives the buffer roller 5, the sheet discharge motor M3 drives the conveying rollers 6, the discharge roller 7*s*, and the sheet discharge rollers 9.

Figure 6:
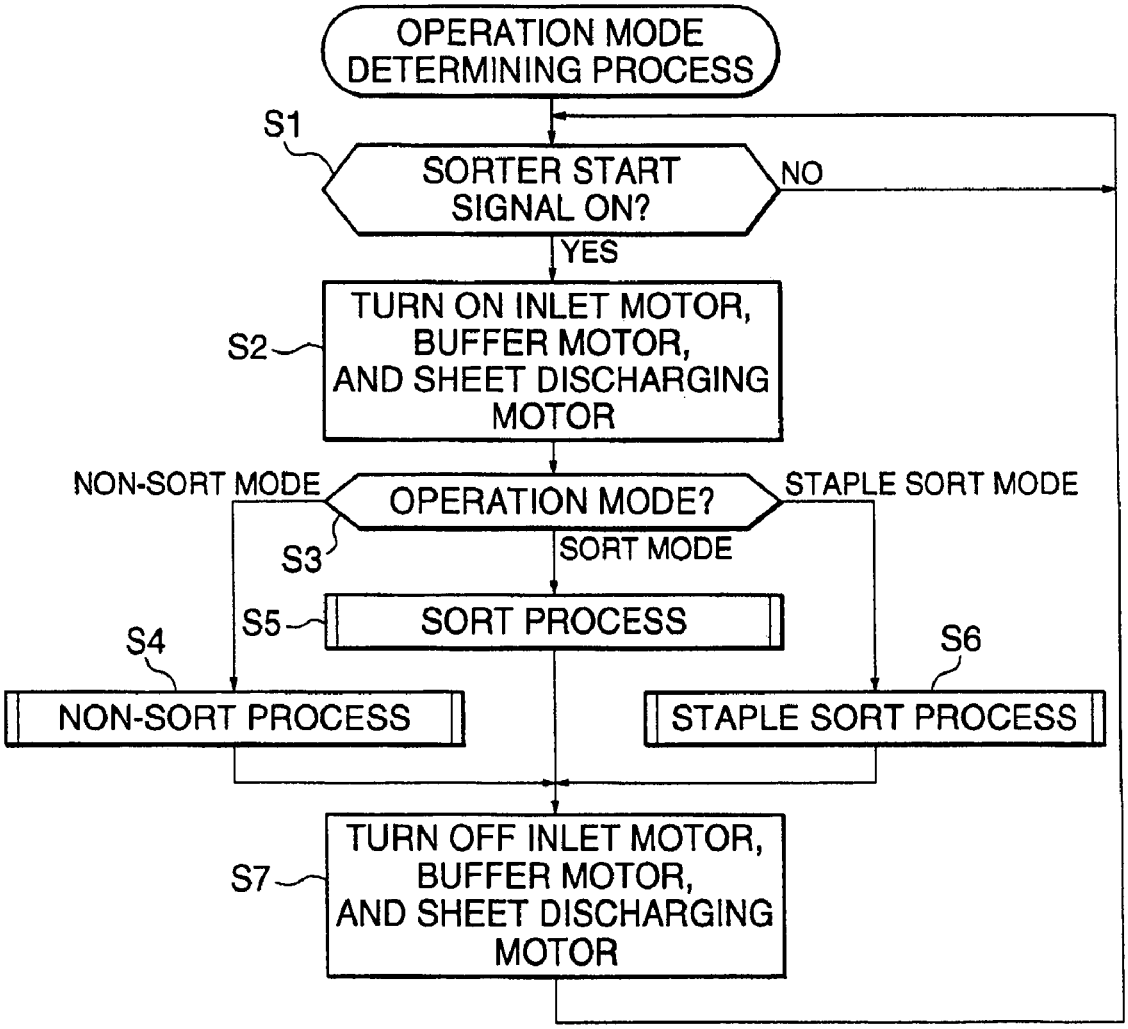
FIG. 6 is a flow chart showing an operation mode determining process carried out by the image forming apparatus in FIG. 1.

FIG. 6 is a flow chart showing an operation mode determining process carried out by the image forming apparatus in FIG. 1. The operation mode determining process is executed by the CPU 401 in the finisher controller 501 according to a program stored in the ROM, not shown, in the finisher controller 501.

First, the sheet processing apparatus 1 waits for a finisher start signal which instructs initiation of operation of the sheet processing apparatus 1 (step S1). In response to depression of a copy start key in the operating section 308 of the image forming apparatus main body 300, the finisher start signal which instructs initiation of the operation of the sheet processing apparatus 1 is inputted from the image forming apparatus main body 300 to the CPU 401 of the finisher controller 501 via the communication IC (IPC). The CPU 401 of the finisher controller 501 then activates the inlet motor M1, the buffer motor M2, and the sheet discharge motor M3 (step S2). On this occasion, if the finisher start signal which instructs initiation of the operation of the sheet processing apparatus 1 is not inputted to the CPU 401 of the finisher controller 501, the sheet processing apparatus 1 is kept on standby.

Subsequently, the CPU 401 of the finisher, controller 501 determines which operation mode is set (step S3). If determining that the operation mode is a non-sort mode in which sheets are not sorted, the CPU 401 of the finisher controller 501 carries out a non-sort process (step S4). If determining that the operation mode is a sort mode in which sheets are sorted, the CPU 401 of the finisher controller 501 carries out a sort process (step S5). Further, if determining that the operation mode is a staple sort mode in which sheets are sorted and stapled, the CPU 401 of the finisher controller 501 carries out a staple sort process (step S6).

Figure 7:
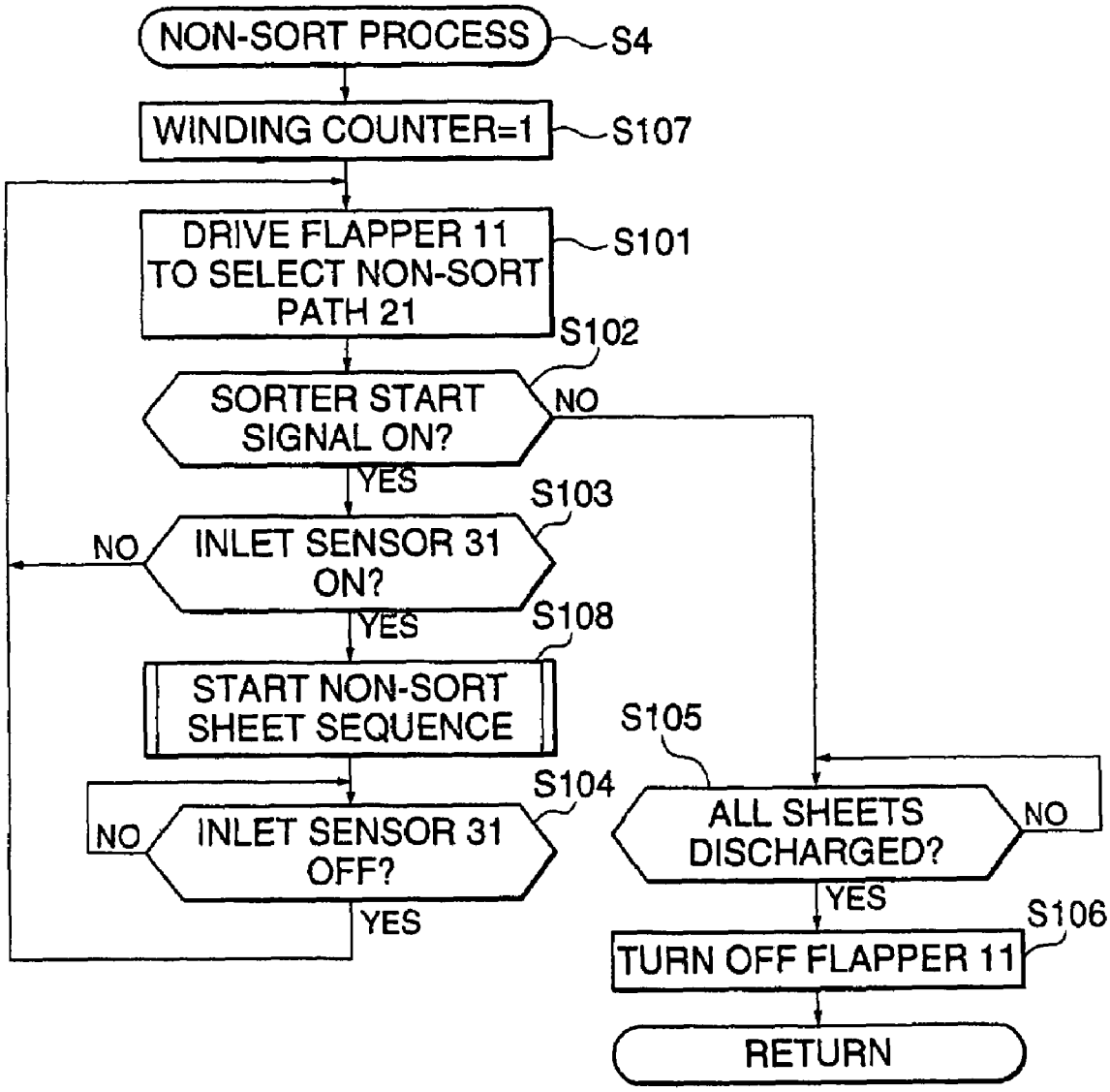
FIG. 7 is a flow chart showing a non-sort process carried out by the image forming apparatus in FIG. 1.

When processing in any of the steps S4 to S6 is completed, the CPU 401 of the finisher controller 501 provides control to stop the inlet motor M1, the buffer motor M2, and the sheet discharge motor M3 (step S7), and the process returns to the step S1 so that the sheet processing apparatus 1 can be brought again into standby state. FIG. 7 is a flow chart showing the non-sort process carried out by the image forming apparatus. The non-sort process is executed in the step S4 if it is determined in the step S3 in FIG. 6 that the operation mode is the non-sort mode.

In the non-sort process, the winding counter that counts the number of sheets being wound around the buffer roller 5 is set to 1(step S107). The reason why sheets are wound around the buffer roller 5 is to temporarily retain the sheets being conveyed so that they can be discharged together with the succeeding sheet to give ample time for processing on the downstream side and improve the productivity. It should be noted that the number of sheets to be wound around the buffer roller 5 is 0 when the count value of the winding counter is set to 0, the number of sheets to be wound around the buffer roller 5 is 1 when the count value of the winding counter is set to 1, and the number of sheets to be wound around the buffer roller 5 is 2 when the count value of the winding counter is set to 2. Although described later in further detail, if the winding counter is set to 1, two superposed sheets are conveyed to the downstream side, and if the winding counter is set to 2, three superposed sheets are conveyed to the downstream side. Next, to guide a sheet P to the sample tray 201, the switching flapper 11 is actuated to select the non-sort path 21 (step S101).

It is then determined whether the finisher start signal has been generated or not (step S102). If it is determined that the finisher start signal has been generated, the sheet P discharged from the image forming apparatus main body 300 is conveyed into a sheet path in the sheet processing apparatus 1. The conveyed sheet P is conveyed via the inlet rollers 2 and the conveying rollers 3 driven by the inlet motor M1, and it is awaited that the leading end of the conveyed sheet P to be detected by the inlet sensor 31 disposed on the sheet path so that the inlet sensor 31 is turned on (step S103).

In response to the turning-on of the inlet sensor 31, a non-sort sheet sequence is started (step S108). It is then awaited that the trailing end of the conveyed sheet P leaves inlet sensor 31 so that the inlet sensor 31 is turned off (step S104). When the inlet sensor 31 is turned off, the process returns to, the step S102 wherein the same processing is repeated as in the case where the finisher start signal has been generated. On the other hand, in the case where the finisher start signal has not been generated, it is awaited that all of sheets are discharged onto the sample tray 201 (step S105), and when all the sheets have been completely discharged, the switching flapper 11 is stopped (step S106) to terminate the non-sort process.

Figure 8:
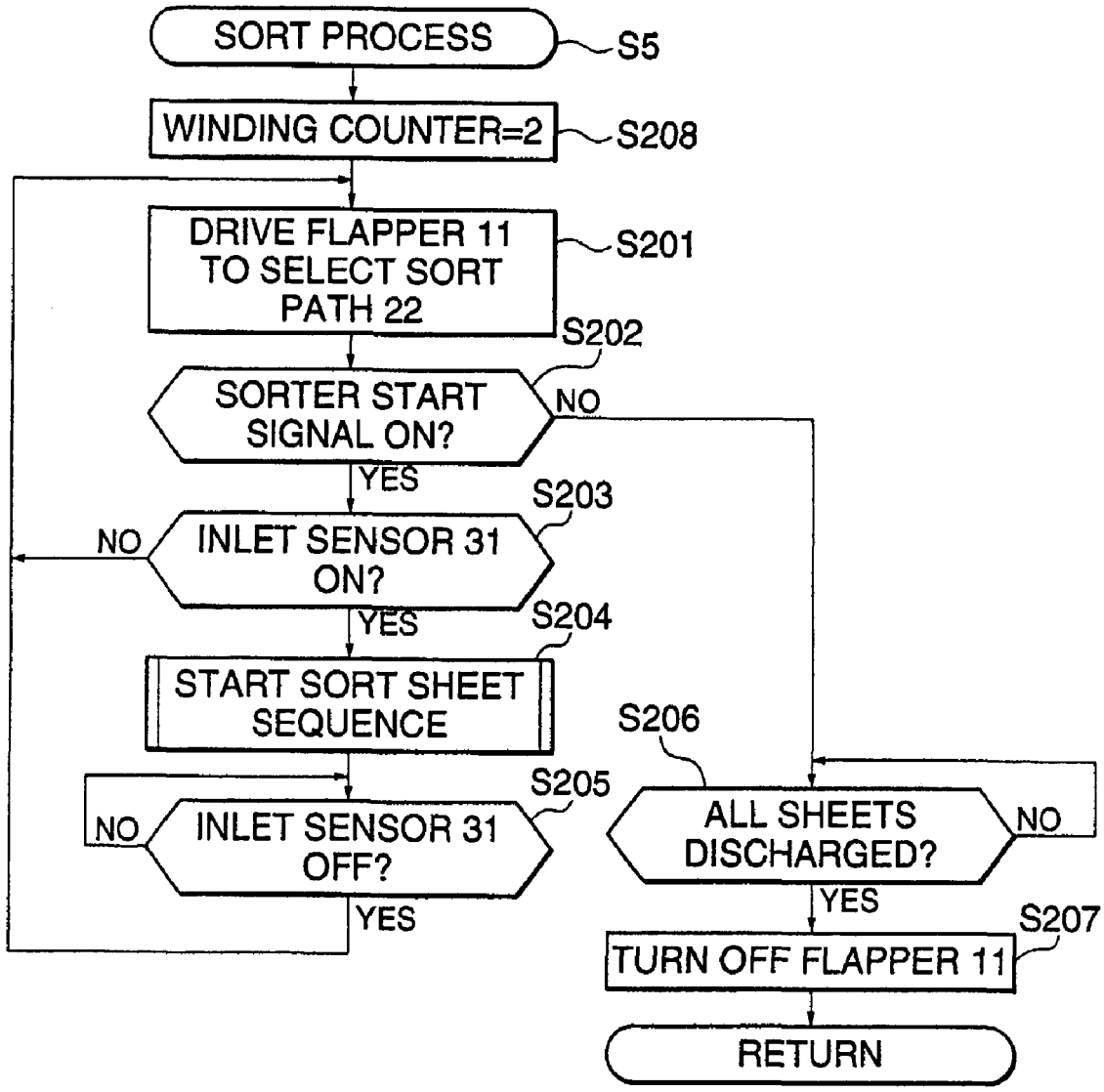
FIG. 8 is a flow chart showing a sort process carried out by the image forming apparatus in FIG. 1.

FIG. 8 is a flow chart showing the sort process carried out by the image forming apparatus. The sort process is executed in the step S5 if it is determined in the step S3 of FIG. 6 that the operation mode is the sort mode.

In the sort process, the winding counter is set to 2 so as to give ample sheet conveyance time intervals; during which sheets P are discharged onto and aligned on the processing tray 130 (step S208). This makes it possible to wind sheets including the first sheet on the buffer roller 5, and even in the case of two-page originals, high productivity can be achieved even for copies including the first copy. Note that the set count value of the winding counter is not limited to 2, but may be any numerical value equal to or smaller than the maximum number of sheets that can be superposed.

Next, the switching flapper 11 is operated to select the sort path 22 (step S201). It is determined whether the finisher start signal has been generated or not (step S202), and if the finisher start signal has been generated, a sheet P discharged from the image forming apparatus main body 300 is conveyed into the sheet path in the sheet processing apparatus 1. The conveyed sheet P is conveyed by the inlet motor M1, and it is awaited that the leading end thereof is detected by the inlet sensor 31 disposed in the sheet path (step S203).

In response to the turning-on of the inlet sensor 31, a sort sheet sequence is started (step S204). It is then awaited that the trailing end of the conveyed sheet P leaves the inlet sensor 31 so that the inlet sensor 31 is turned off (step S205). When the inlet sensor 31 is turned off, the process returns to the step S202 wherein the same processing is repeated as in the case where the finisher start signal has been generated. On the other hand, in the case where the finisher start signal has not been generated, it is awaited that all of sheets are discharged onto the processing tray 130 (step S206). When all the sheets have been completely discharged onto the processing tray 130, the switching flapper 11 is stopped (step S207) to terminate the sort process.

Figure 9:
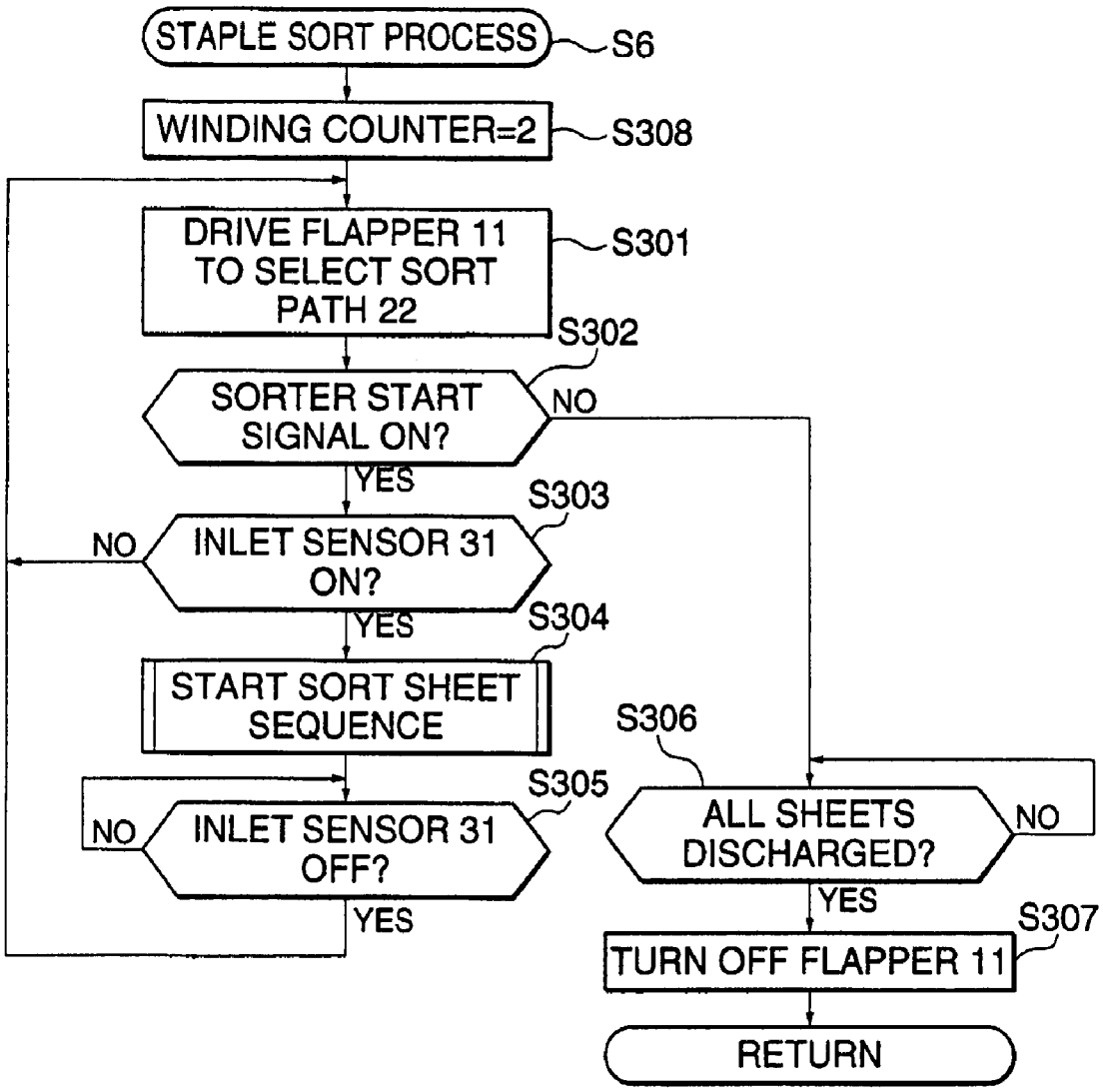
FIG. 9 is a flow chart showing a staple sort process carried out by the image forming apparatus in FIG. 1.

FIG. 9 is a flow chart showing the staple sort process carried out by the image forming apparatus. The staple sort process is executed in the step S6 if it is determined in the step S3 of FIG. 6 that the operation mode is the staple sort mode. In the staple sort process, the winding counter is set to 2 so as to give ample sheet conveyance time intervals during which sheets P are discharged onto and aligned on the processing tray 130 (step S308). This makes it possible to wind sheets including the first sheet on the buffer roller 5, and even in the case of two-page originals, high productivity can be achieved even for the first copy.

Next, the switching flapper 11 is operated to select the sort path 22 (step S301). It is determined whether the finisher start signal has been generated or not (step S302), and if the finisher start signal has been generated, a sheet P discharged from the image forming apparatus main body 300 is conveyed into the sheet path in the sheet processing apparatus 1. The conveyed sheet P is conveyed by the inlet motor M1, and it is awaited that the leading end thereof is detected by the inlet sensor 31 disposed in the sheet path so that the inlet sensor 31 is turned on (step S303). In response to the turning-on of the inlet sensor 31, the sort sheet sequence is started (step S304).

It is then awaited that the trailing end of the conveyed sheet P leaves the inlet sensor 31 and the inlet sensor 31 is turned off (step S305). When the inlet sensor 31 is turned off, the process returns to the step S302, so that the same processing is repeated as in the case where the finisher start signal has been generated. On the other hand, in the case where the finisher start signal has not been generated, it is awaited that all of sheets are discharged onto the processing tray 130 (step S306). When all the sheets have been completely discharged onto the processing tray 130, the switching flapper 11 is stopped (step S307) to terminate the staple sort process.

Figure 10:
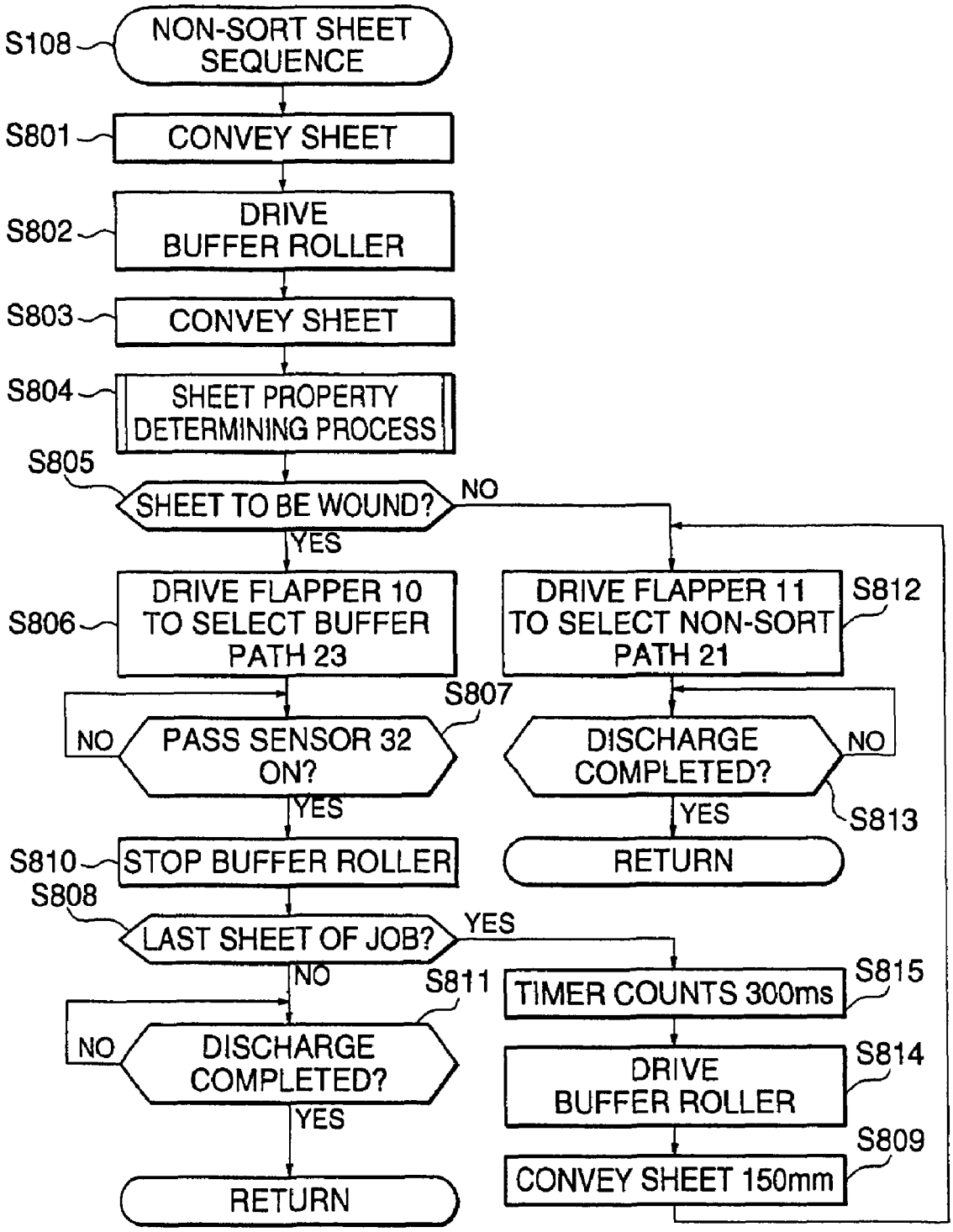
FIG. 10 is a flow chart showing a non-sort sheet sequence carried out by the image forming apparatus in FIG. 1.

FIG. 10 is a flow chart showing the non-sort sheet sequence executed by the image forming apparatus. The non-sort sheet sequence is executed in the step S108 of the non-sort process shown in FIG. 7, and executed for each of sheets to be conveyed. This sequence is executed in multitasking according to a program by the CPU 401 of the finisher controller 501.

In the non-sort sheet sequence first, a sheet is conveyed by a distance of 50 mm, for example (step S801), and the buffer motor M2 is activated to drive the buffer roller 5 (step S802). Since the sort sheet sequence is started in response to turning-on of the inlet sensor 31, the buffer motor M2 is activated at a time point the leading end of the sheet has been conveyed by 50 mm downstream from such a position where the inlet sensor 31 is turned on. The motor actuation timing is intended for succeeding sheet conveyance, and is timing for restarting the buffer roller 5 on which a "wound sheet" is wound at a stop. Activating the buffer motor M2 in this timing enables the wound sheet and the succeeding sheet to be conveyed in superposition.

Although in the present embodiment, the value of 50 mm is set as the condition for defining the timing, any arbitrary value may be set as this condition. Next, the sheet is conveyed by 150 mm (step S803), and a sheet property determining process is carried out (step S804). In the sheet property determining process, which will be described in detail later, the properties of the sheet being conveyed are determined, that is, it is determined whether the sheet is a sheet to be wound or a sheet to be stacked on the processing tray 130 and discharged in a bundle with other sheets.

It is determined in the sheet property determining process whether the sheet is the wound sheet or not (step S805), and if it is determined that the sheet is the wound sheet, the switching flapper 10 is operated to select the buffer path 23 (step S806). The sheet is conveyed directly to the buffer path 23 so that the sheet can be wound around the buffer roller 5. Then, when the pass sensor 32 on the buffer path 23 is turned on (step S807), the buffer motor M2 is controlled to be stopped, so that the sheet can be wound around the buffer roller 5 (step S810). The buffer roller 5 is stopped when the leading end of the sheet passes the pass sensor 32, but this causes no problem since the amount of overrun is taken into consideration in performing the winding operation.

After the buffer roller 5 is stopped, it is determined whether the sheet is the last sheet of a job or not (step S808). If it is determined that the sheet is not the last sheet of the job, the sheet awaits while being wound around the buffer roller 5 until the succeeding sheet causes the buffer roller 5 to be reactivated. After the reactivation of the buffer roller 5, the process is terminated at a time point the sheet has been discharged onto the sample tray 201 (step S811).

On the other hand, if it is determined in the step S808 that the sheet is the last sheet of the job, the buffer roller 5 is stopped for a predetermined period of time (for example, 300 ms) (step S815), and the buffer roller 5 is then reactivated (step S814). Thereafter, the sheet is conveyed by 150 mm (step S809), and the switching flapper 11 is operated to select the non-sort path 21 (step S812). The process is terminated at a time point the sheet has been completely discharged onto the sample tray 201 (step S813).

If it is determined in the step S805 that the sheet is not the wound sheet, the switching flapper 11 is operated to select the non-sort path 21 (step S812). The process is terminated at a time point the sheet has been completely discharged onto the sample tray 201 (step S813).

In the case where two superposed sheets are discharged each time, if one copy is made from an odd number of originals or if an odd number of copies are made from one-sheet original, the last sheet cannot be superposed, and hence it is impossible to give ample sheet conveyance time intervals required for discharge control. If the last sheet is designated as a sheet to be wound as in the present embodiment, however, the last sheet is wound around the buffer roller 5 and is discharged after the buffer roller 5 is temporarily stopped even though there is no sheet on which the last sheet is to be superposed. Therefore, it is possible to give constant sheet conveyance time intervals.

Although in the present embodiment, the last sheet is kept at a stop for 300 ms, the present invention is not limited to this, but the last sheet maybe stopped for any period of time insofar as it is kept at a stop for a period of time required for discharge control. Further, according to time required for discharge control, the last sheet may be passed through the buffer path without being stopped. Further, although in the present embodiment, the path where a sheet is retained and the normal path are not identical, the present invention is not limited to this, but they may be identical.

Figure 11:
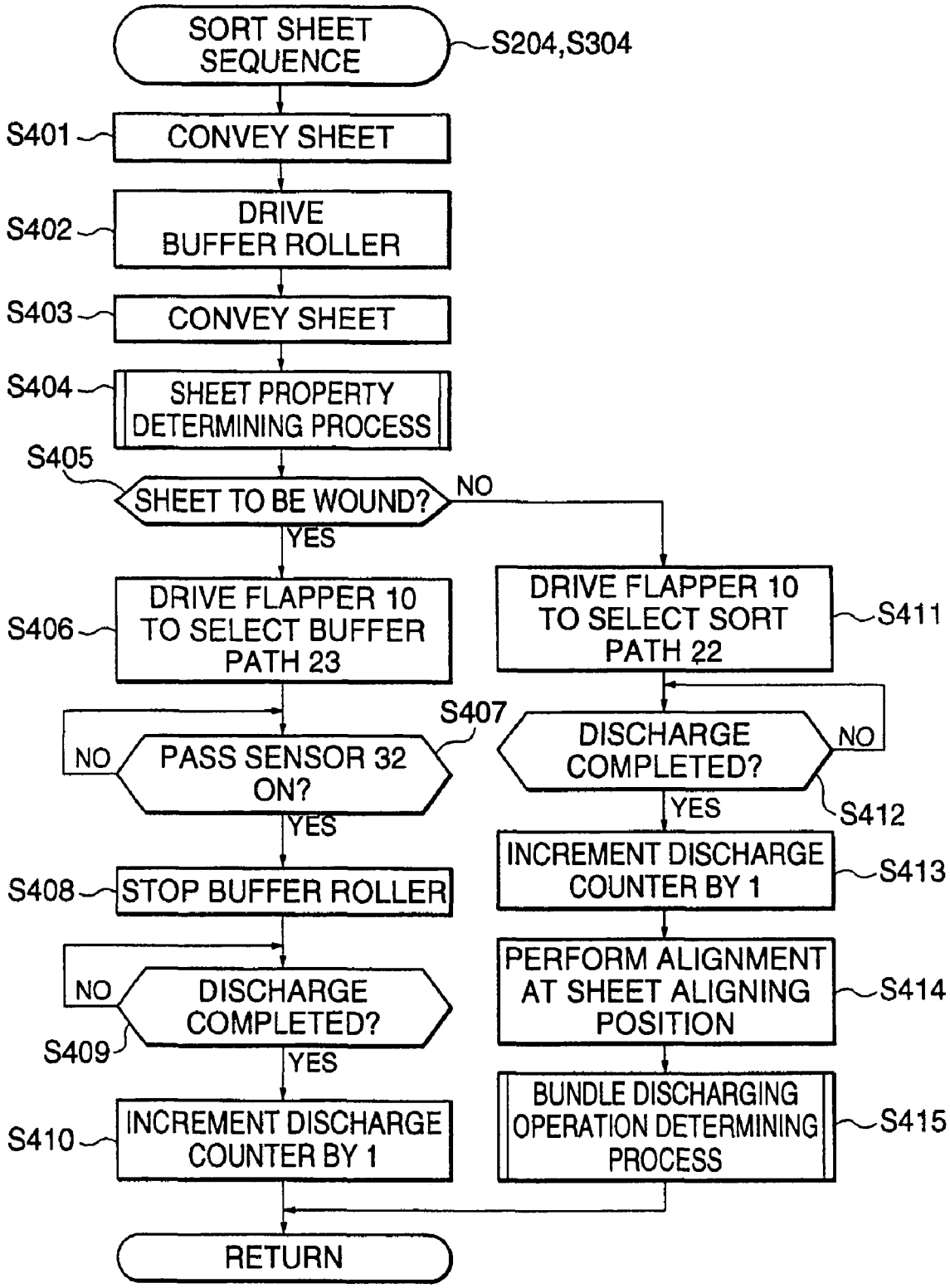
FIG. 11 is a flow chart showing a sort sheet sequence carried out by the image forming apparatus in FIG. 1.

FIG. 11 is a flow chart showing the sort sheet sequence executed by the image forming apparatus. The sort sheet sequence is executed in the step S204 of the sort process in FIG. 8 and the step S304 of the staple sort process in FIG. 9, and executed for each of sheets to be conveyed. This sequence is executed in multitasking according to a program by the CPU 401 of the finisher controller 501.

In the sort sheet sequence, first, a sheet is conveyed by 50 mm, for example (step S401), and the buffer motor M2 is activated to drive the buffer roller 5 (step S402). Since the sort sheet sequence is started in response to turning-on of the inlet sensor 31, the buffer motor M2 is activated at a time point the leading end of the sheet has been conveyed by 50 mm downstream from such a position where the inlet sensor 31 is turned on. The motor actuation timing is intended for succeeding sheet conveyance, and is timing for restarting the buffer roller 5 on which a "wound sheet" is wound at a stop. Activating the buffer motor M2 in this timing enables the wound sheet and the succeeding sheet to be conveyed in superposition.

Although in the present embodiment; the value of 50 mm is set at the condition for defining the timing, but any arbitrary value may be set as this condition. Next, the sheet is conveyed by 150 mm (step S403), and the sheet property determining process is carried out (step S404). In the sheet property determining process, which will be described in detail later, the properties of the sheet being conveyed are determined, that is, it is determined whether the sheet is a sheet to be wound or a sheet to be stacked on the processing tray 130 and discharged in a bundle with other sheets.

It is determined in the sheet property determining process whether the sheet is to be wound or not (step S405), and if it is determined that the sheet is to be wound, the switching flapper 10 is operated to select the buffer path 23 (step S406). The sheet is conveyed directly to the buffer path 23 so that the sheet can be wound around the buffer roller 5. Then, when the pass sensor 32 on the buffer path 23 is turned on (step S407 and S408), the buffer motor M2 is controlled to be stopped so that the sheet can be wound around the buffer roller 5 (step S410). The buffer roller 5 is stopped when the leading end of the sheet passes the pass sensor 32, but this causes no problem since the amount of overrun is taken into consideration in performing the winding operation.

After the buffer roller 5 is stopped, the sheet is caused to wait while being wound around the buffer roller 5 until the succeeding sheet causes the buffer roller 5 to be reactivated. After the reactivation of the buffer roller 5, when the sheet has been completely discharged onto the processing tray 130 (step S409), the discharge counter indicative of the number of sheets discharged onto the processing tray 130 is incremented by 1, followed by termination of the present process (step S410).

On the other hand, if it is determined in the step S405 that the sheet is not to be wound, the switching flapper 11 is operated to select the sort path 22 (step S411). Due to the selection of the sort path 22, the sheet is not guided to the buffer path 23, but is guided to a discharge path extending to the processing tray 130. After the sheet has been completely discharged onto the processing tray 130 (S412), the discharge counter is incremented by 1 (S413), and alignment is carried out using two aligning members at a sheet aligning position set for each sheet (step S414). At the same time while the sheet is discharged onto the processing tray 130, alignment of sheets is carried out in a direction substantially perpendicular to the sheet conveying direction, and the pull-in paddle 160 is rotated to align the sheets in the sheet conveying direction. Next, a bundle discharging operation determining process, described later, is carried out (step S415), followed by termination of the present process.

Figure 12:
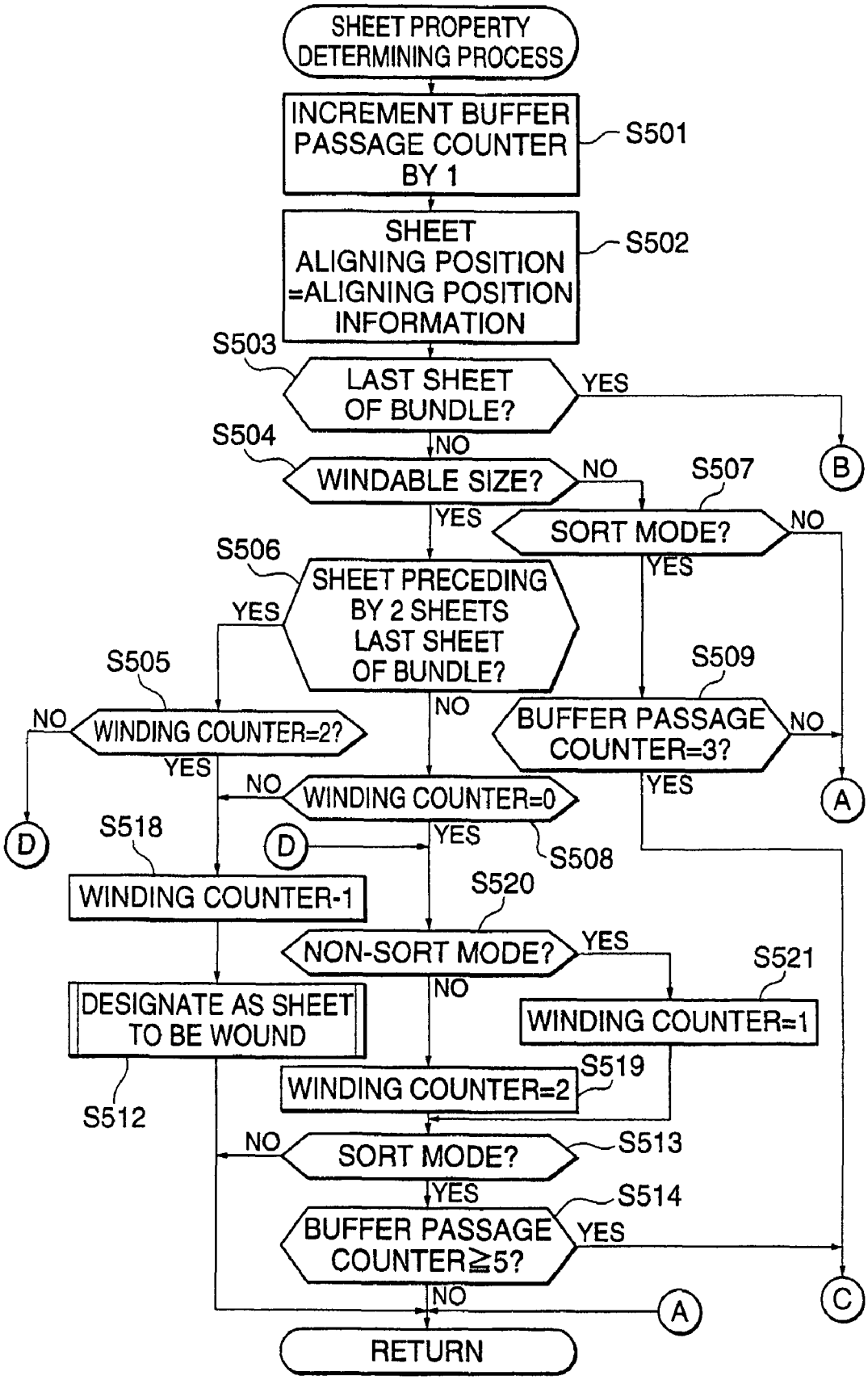
FIG. 12 is a flow chart showing a sheet property determining process carried out by the image forming apparatus in FIG. 1.
Figure 13:
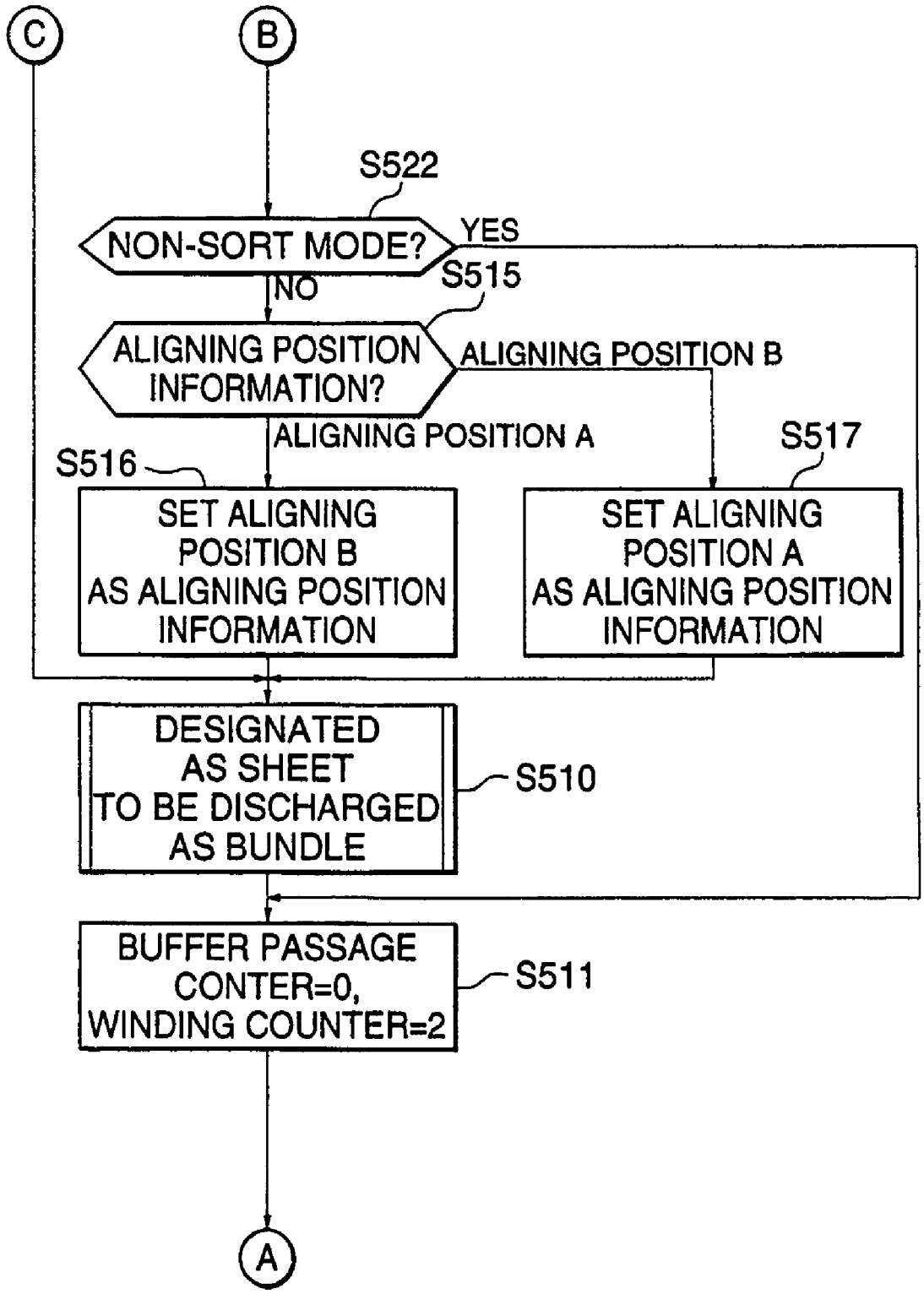
FIG. 13 is a continued part of the flow chart in FIG. 12.

FIGS. 12 and 13 are flow charts showing the sheet property determining process carried out by the image forming apparatus. The sheet property determining process is carried out in the step S404 of the sort sheet sequence in FIG. 11 and the step S804 of the non-sort sheet sequence in FIG. 10, described above.

First, the buffer passage counter indicative of the number of sheets having passed the buffer roller 5 is incremented by 1 (step S501). Then, information indicative of whether each sheet is to be aligned to the front or to the rear as viewed from the operator in sorting bundles when the sheet has been discharged onto the sample tray 201 is set as information related to each sheet (sheet aligning position) (step S502). Next, it is determined whether the present sheet is the last sheet of a bundle or not (step S503). Here, a bundle of sheets means a unit of sorting in the sort mode, a unit of stapling in the staple sort, mode, or a unit of job in the non-sort mode.

If it is determined that the present sheet is not the last sheet of a bundle, it is then determined whether the sheet is of a size that permits it td be wound around the buffer roller 5 or not (step S504). If it is determined that the sheet is of a size that permits it to be wound around the buffer roller 5, then it is determined whether the sheet is a sheet preceding by two sheets the last sheet of the bundle or not (step S506). If it is determined that the sheet is a sheet preceding by two sheets the last sheet of the bundle, it is determined whether the count value of the winding counter indicative of the maximum number of sheets that can be wound is 2 or not (step S505). If the count value of the winding counter is 2, the winding counter is decremented by 1 (step S518), and the sheet is designated as a sheet to be wound (step S512). The reason why a sheet is wound around the buffer roller 5 is to temporarily retain the sheet being conveyed so that the sheet and the succeeding sheet can be discharged at the same time to give ample time for processing on the downstream side and improve the productivity.

On the other hand, if it is determined in the step S504 that the count value of the winding counter is not 2, it is then determined whether the operation mode is the non-sort mode or not (step S520). If it is determined that the operation mode is the non-sort mode, the winding counter is set to 1 (step S521), and if it is determined that the operation mode is not the non-sort mode, the winding counter is set to 2 (step S519). The reason why the sheet winding counter is set to 2 or 1 is to improve the productivity and the durability by winding every sheet to be discharged onto the processing tray 130. Further, by varying the count value of the winding counter according to the processing mode, it is possible to set the number of sheets to be superposed according to the sheet destinations in the case where there ate two or more destinations differing in the number of sheets to be discharged and stacked at the same time.

It is then determined whether the operation mode is the sort mode or not (step S513). If it is determined that the operation mode is not the sort mode, that is, the operation mode is the staple sort mode, the present process is terminated. On the other hand, if it is determined that the operation mode is the sort mode, it is determined whether or not the count value of the buffer passage counter is equal to or greater than 5 (step S514). If it is determined that the count value of the buffer passage counter is equal to or greater than 5, the buffer pass age counter is set to 0 and the winding counter is set to 2 (step S510), and the sheet is designated as the "sheet to be discharged in a bundle" from the processing tray 130 (step S511). Otherwise, the process is terminated.

On the other hand, if it is determined in the step S506 that the sheet is not a sheet preceding by two sheets the last sheet of the bundle, it is then determined whether the count value of the winding counter is 0 or not (step S508). If the count value of the winding counter is not 0, the winding counter is decremented by 1 (step S518), and the sheet is designated as the sheet to be wound (step S512). The reason why a sheet is wound is to temporarily retain the sheet being conveyed so that it can be discharged together with the succeeding sheet to give ample time for processing on the downstream side and improve the productivity.

On the other hand, if it is determined in the step S508 that the count value of the winding counter is 0, it is then determined whether the operation mode is the non-sort mode or not (step S520). If it is determined that the operation mode is the non-sort mode, the winding counter is set to 1 (step S521), and if it is determined that the operation mode is not the non-sort mode, the winding counter is set to 2 (step S519). It is then determined whether the operation mode is the sort mode or not (step S513). If it is determined that the operation mode is not the sort mode, that is, the operation mode is the staple sort mode, the process is terminated. On the other hand, if it is determined that the operation mode is the sort mode, it is then determined whether or not the count value of the buffer passage counter is equal to or greater than 5 (step S514). If it is determined that the count value of the buffer passage counter is equal to or greater than 5, and the sheet is designated as the sheet to be discharged in a bundle from the processing tray 130 (step S510), the buffer passage counter is set to 0 and the winding counter is set to 2 (step S511). Otherwise, the process is terminated.

On the other hand, if it is determined in the step S504 that the sheet is not of a size that permits it to be wound around the buffer roller 5, it is then determined whether the operation mode is the sort mode or not (step S507). If it is determined that the operation mode is not the sort mode but the staple mode, the process is terminated, and if it is determined that the operation mode is the sort mode, it is then determined whether the count value of the buffer passage counter is 3 or not (step S509). If the count value of the buffer passage counter is not 3, the process is terminated, and if the count value of the buffer passage counter is 3, the above described processing in the step S510 and S511 is performed.

The above described processing in the steps S510 and S511 is intended to designate a sheet being conveyed as the sheet to be discharged in a bundle, and accordingly set the counters (clear the buffer passage counter and set the winding counter). The designation of a sheet as one to be discharged in a bundle means that when the discharge of a bundle of sheets from the processing tray 130 onto the stack tray 200 is started when the conveyed sheets have been discharged onto and stacked on the processing tray 130. The designation is used in the bundle discharge operation determining process, described later.

On the other hand, if it is determined in the step S503 that the conveyed sheet is the last sheet of the bundle, it is then determined whether the operation mode is the non-sort mode or not (step S522). If it is determined that the operation mode is the non-sort mode, the process proceeds to the above described step S510. On the other hand, if it is determined that the operation mode is not the non-sort mode, the set aligning position information is set to invert the aligning position. The aligning position information is set for each sheet. For example, assuming that an aligning position A is set at the front and an aligning position B is set at the rear as viewed from the operator, if it is determined that the aligning position A is set as the aligning position information (step S515), the aligning position B is set as the aligning position information. On the other hand, if it is determined that the aligning position B is set as the aligning position information, the aligning position A is set as the aligning position information (step S517). Setting the aligning position information to invert the alignment position in this way enables bundles of sheets to be sorted (offset from each other) on the processing tray 130 and the stack tray 200. The process then proceeds to the above described step S510.

This completes the determining and setting operations regarding the properties of sheets (whether sheets are to be wound or not and whether sheets are to be discharged in a bundle or not).

Figure 14:
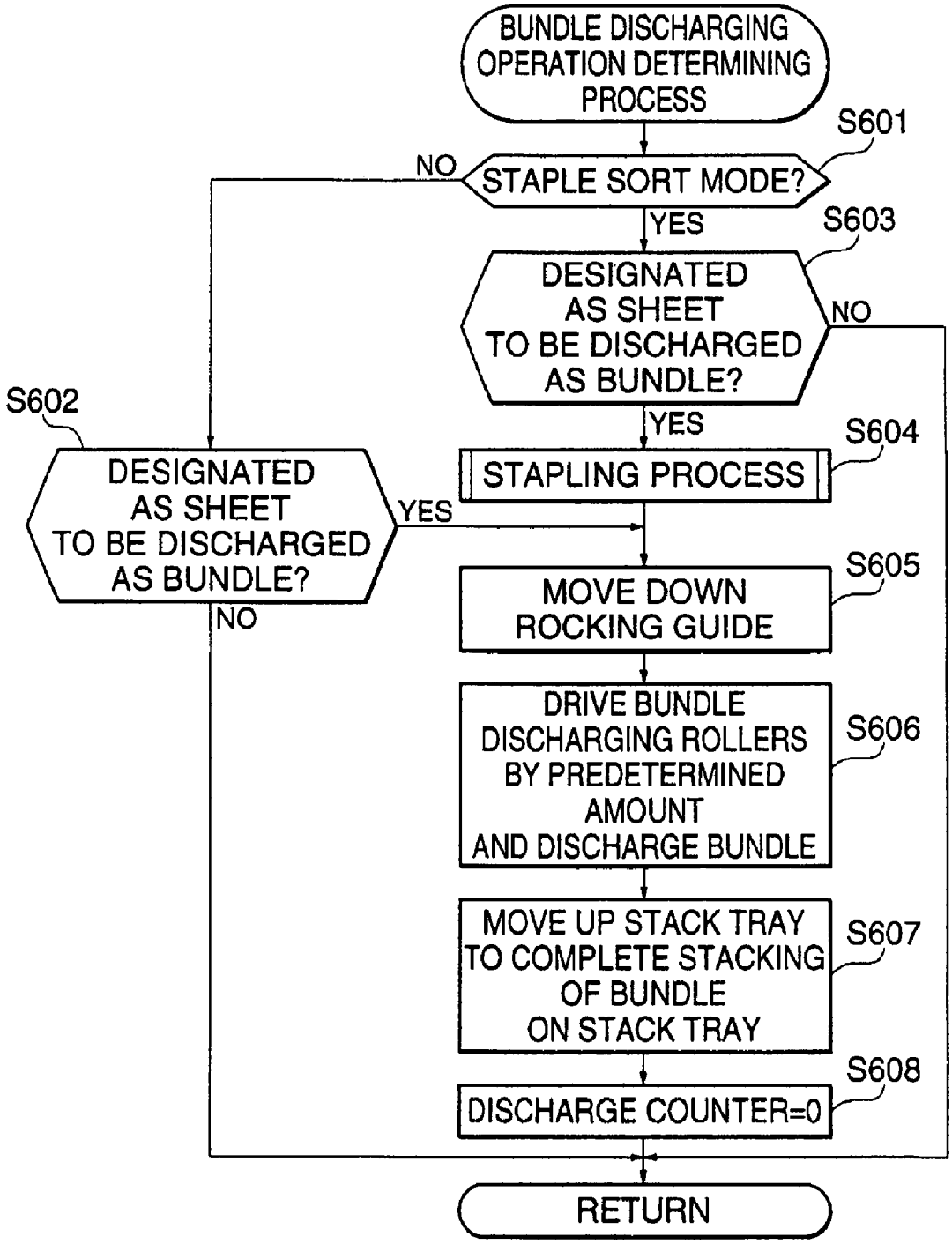
FIG. 14 is a flow chart showing a bundle discharging operation determining process carried out by the image forming apparatus in FIG. 1.

FIG. 14 is a flow chart showing the bundle discharging operation determining process carried out by the image forming apparatus. The bundle discharging operation determining process is executed in the step S415 of the above described sort sheet sequence in FIG. 11.

In the bundle discharging operation determining process, it is determined first whether the operation mode is the staple sort mode or not (step S601). If it is determined that the operation mode is not the staple sort mode, it is then determined whether the sheet discharged onto the processing tray 130 is to be discharged in a bundle or not (step S602). If it is determined that the sheet is not to be discharged in a bundle, the process is terminated to return to the above described sort sheet sequence.

On the other hand, if it is determined in the step S602 that the sheet discharged onto the processing tray 130 is to be discharged in a bundle, the rocking guide 150 is operated to bring the bundle discharge upper roller 180*b* into abutment with the bundle of sheets on the processing tray 130. Then, when the bundle discharge upper roller 180*b* has ceased bouncing, the bundle discharge upper roller 180*b* is driven by a predetermined amount to discharge the bundle of sheets on the processing tray 130 onto the stack tray 200 while the speed of a bundle discharge motor, not shown, is being controlled (step S606). The stack tray 200 is then moved up or down to complete stacking the bundle of sheets on the stack tray 200 (step S607). Thereafter, the discharge counter is set to 0 (step S608) to complete the process.

On the other hand, if it is determined in the step S601 that the operation mode is the staple sort mode, it is then determined whether the sheet discharged onto the processing tray 130 is to be discharged in a bundle or not (step S603). If it is determined whether the sheet is not to be discharged in a bundle, the process is terminated to return to the above described sort sheet sequence in FIG. 11. On the other hand, if it is determined that the sheet discharged onto the processing tray 130 is to be discharged in a bundle, the process proceeds to the staple sort sequence in FIG. 9 (step S604). When the bundle of sheets on the processing tray 130 has been completely stapled, the process proceeds to the above described step S605 wherein the rocking guide 150 is moved down to discharge the bundle of sheets as described above (steps S605 to S608). The process is then terminated to return to the sort sheet sequence in FIG. 11.

Figure 15:
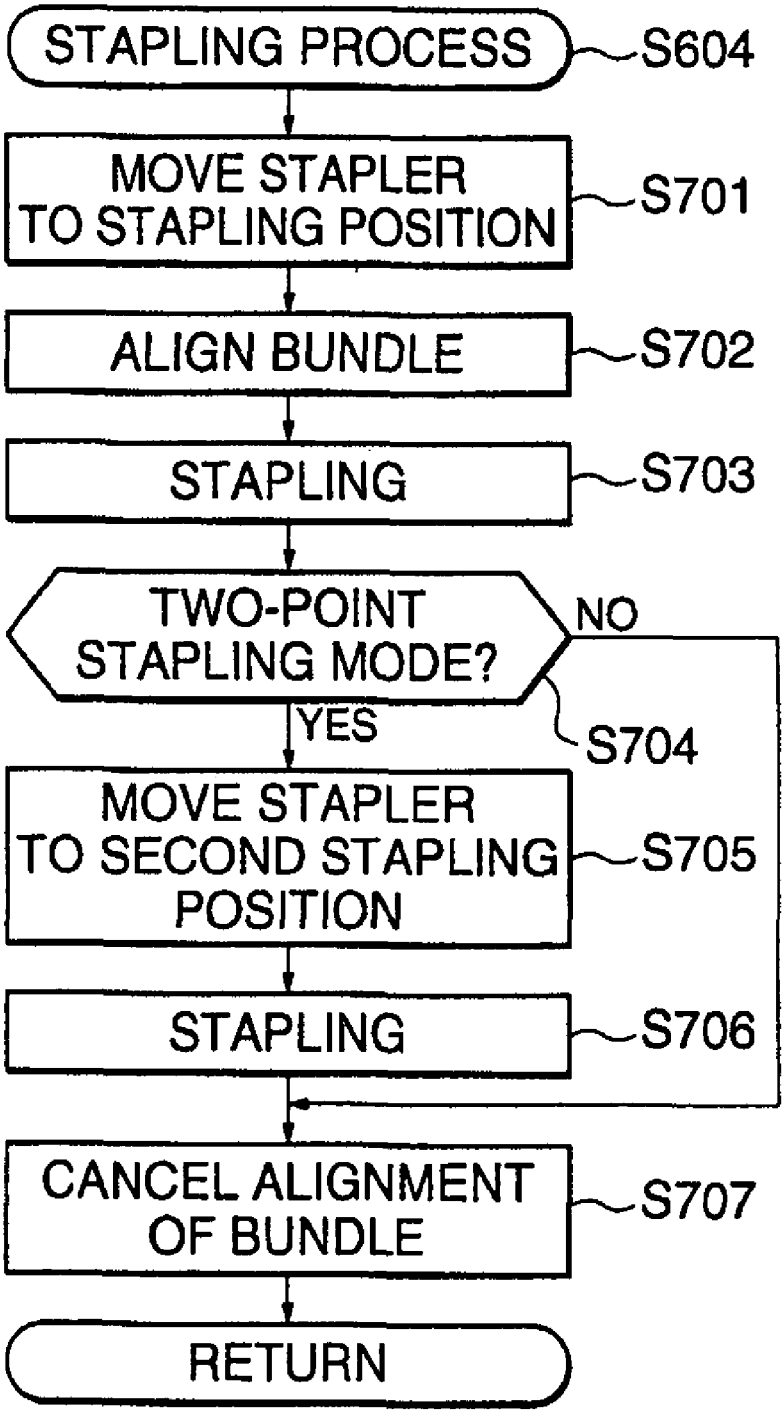
FIG. 15 is a flow chart showing a stapling process carried out by the image forming apparatus in FIG. 1.

FIG. 15 is a flow chart showing a stapling process carried out by the image forming apparatus. The stapling process is executed in the step S604 of the above described bundle discharging operation determining process shown in FIG. 14.

In the stapling process, first, a stapler 101 is moved by a predetermined amount up to a stapling position (step S701), and the bundle of sheets on the processing tray 130 is aligned by the aligning device 140 comprised of the front aligning member 141 and the rear aligning member 142 (step S702) and then stapled (step S703). It is then determined whether the operation mode is a two-point stapling mode or not (step S704). If it is determined that the operation mode is not the two-point stapling mode, the alignment of the bundle of sheets using the aligning device 140 comprised of the front aligning member 141 and the rear aligning member 142 is canceled (step S707), followed by termination of the stapling process.

On the other hand, if it is determined in the step S704 that the operation mode is the two-point stapling mode, the stapler 101 is moved by a predetermined amount up to a second stapling position (step S705) to staple the bundle of sheets at the second stapling position (step S706). The alignment of the bundle using the aligning device 140 is then canceled (step S707), followed by the stapling process being terminated.

Figure 16A:
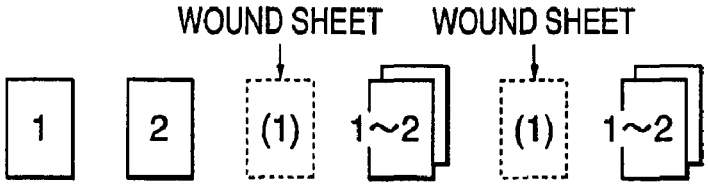
FIGS. 16A to 16E are views useful in explaining concrete examples of a winding process carried out by the image forming apparatus in FIG. 1.
Figure 16B:
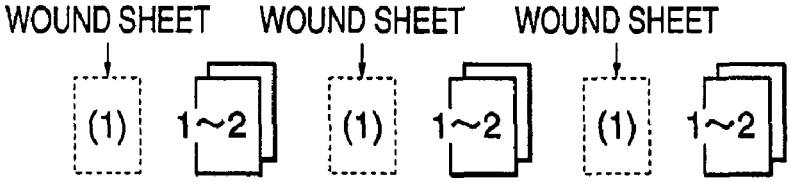

A description will now be given of concrete examples of winding performed by the image forming apparatus based on the sheet property determining process. FIGS. 16A to 16E are views useful in explaining the concrete examples of winding performed by the image forming apparatus. FIG. 16B shows the case where two-page originals are subjected to processing. In this case, regarding the first sheet of a job, the winding counter is set to 2 (step S208 in FIG. 8 and step S308 in FIG. 9), and the sheet is designated as a sheet to be wound (step S512) and wound around the buffer roller 5. The first sheet is superposed upon the second sheet as the last sheet, and they are discharged onto the processing tray 130.

As described above, by designating the first sheet of a job as a sheet to be wound, even in the case of two-page originals it is possible to inhibit the, succeeding sheet from falling upon the processing tray 130 even for the first copy while the first sheet is aligned by the processing tray 130, and enable alignment without stopping the operation of the image forming apparatus main body.

It should be noted that, if the first sheet of a job is not wound, the last sheet is discharged onto the processing tray 130 while the first sheet is aligned as shown in FIG. 16B, which causes troubles such as sheet jam due to time shortage.

Figure 16C:
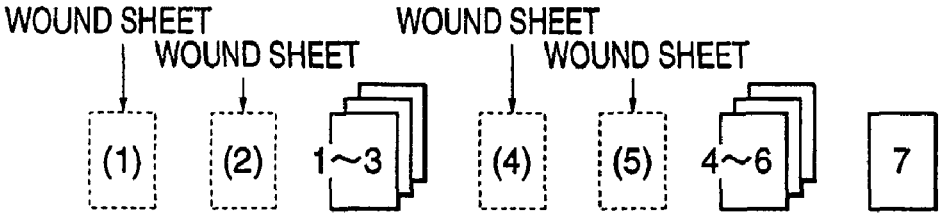
Figure 16D:
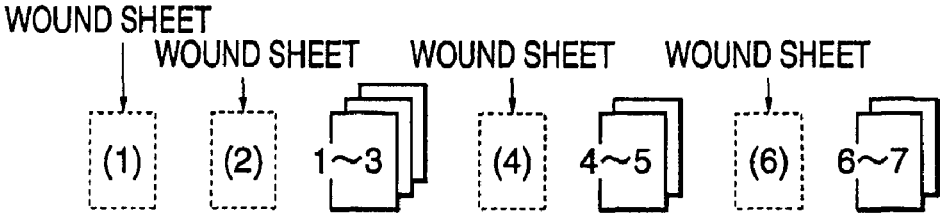

FIG. 16D shows the case where seven-page originals are subjected to processing. In this case, regarding the first sheet of a job, the winding counter is set to 2 (step S208 in FIG. 8 and step S308 in FIG. 9), and is designated as a sheet to be wound (step S512 in FIG. 12), so that the sheet is wound around the buffer roller 5. Similarly, the second sheet of the job is also designated as a sheet to be wound (step S512 in FIG. 12), and is wound around the buffer roller 5 such that the first sheet and the second sheet are superposed. Subsequently, the third sheet and the first and second sheets wound around the buffer roller 5 are superposed, so that the total three sheets are discharged onto the processing tray 130.

The succeeding fourth sheet is designated as a sheet to be wound (step S512 in FIG. 12), and is wound around the buffer roller 5. Since the succeeding fifth sheet is a sheet preceding by two sheets the last sheet of a bundle (step S506 in FIG. 12), the fifth sheet and the fourth sheet wound around the buffer roller 5 are superposed and discharged onto the processing tray 130. The succeeding sixth sheet is designated as a sheet to be wound (step S512), and is wound around the buffer roller 5. The succeeding seventh sheet as the last sheet and the sixth sheet wound around the buffer roller 5 are superposed and discharged onto the processing tray 130.

As described above, if there is a sheet wound around the buffer roller 5 before a sheet preceding by two sheets the last sheet (the third sheet from the last one) reaches the buffer roller 5, the sheet preceding by two sheets the last sheet and the sheet wound around the buffer roller 5 are superposed and discharged together onto the processing tray 130, and the remaining two sheets are superposed and discharged together onto the processing tray 130. As a result, it is possible to provide a sheet conveyance time interval corresponding to two sheets in a reliable manner, and to realize alignment while preventing the succeeding sheet from being discharged onto the processing tray 130 during alignment on the processing tray 130, and prevent the image forming apparatus main body 300 from stopping its operation. It should be noted that a sheet preceding by N sheets the last sheet means an N+1th sheet from the last one, and N is a numerical value within the range from 2 to a value which is one smaller than the maximum number of sheets that can be superposed.

It should be noted that in the step S506 of FIG. 12, if the present sheet is designated as a sheet to be wound although it is a sheet preceding by two sheets the last sheet of a bundle, the last sheet is discharged onto the processing tray 130 while the fourth to sixth sheets are being aligned in the case of seven-page originals as shown in FIG. 16C, which causes troubles such as sheet jam due to time shortage.

As described above, according to the first, embodiment, in the sheet discharging process carried out by the sheet processing apparatus attached to the image forming apparatus, two sheets or more are always superposed irrespective of the number of sheets included in a bundle, and are discharged together onto the stack tray 200 or the sample tray 201 via the processing tray 130, and hence, even if conveyance time intervals between sheets discharged from the image forming apparatus main body 300 to the sheet processing apparatus 1 are short, it is possible to provide control to reduce the speed at which sheets are discharged by the discharging device, and to reduce the size of the driving system for the alighting device since an aligning device that can perform each alignment at a high speed is not required. Furthermore, it is possible to reduce the number of times of operation to be performed by the aligning device 140, thus improving the durability of the driving system for the aligning device 140.

The above described first embodiment encompasses a sheet processing apparatus that causes a sheet superposing device to superpose sheets such that conveyance time intervals between sheets being conveyed onto a processing tray are wider than conveyance time intervals between sheets being received by the sheet processing apparatus in the case where an alignment operation is carried out by an aligning device.

A description will now be given of a second embodiment of the present invention.

Although in the above described first embodiment, three sheets are superposed and discharged, and whether a sheet preceding by two sheets the last one of a bundle is to be wound around the buffer roller 5 or not is determined when the sheet reaches the buffer roller 5, the present invention is not limited to this, but in the case where B sheets can be always superposed and discharged, whether the sheet is to be wound around the buffer roller 5 or not may be determined when any one of a sheet preceding by (B-1) sheets the last sheet of a bundle reaches the buffer roller 5.

Further, although in the above described first embodiment, two sheets are wound around the buffer roller 5 and superposed upon the succeeding third sheet and stacked on the processing tray 130, the number of sheets to be wound is not limited to 2 but may be one or three or more or may be arbitrarily set according to the conveying speed of sheets conveyed from the image forming apparatus body 300 to which the sheet processing apparatus 1 is attached, the bundle discharging operation, and so forth.

Figure 16E:
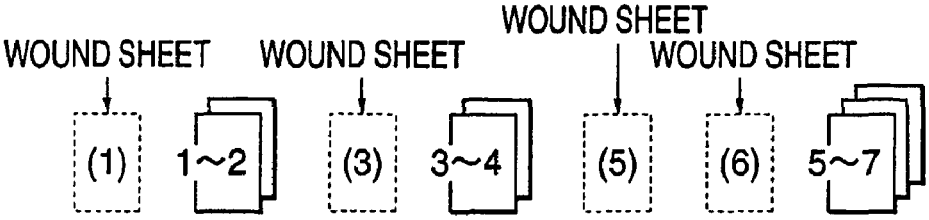

Further, although in the above described first embodiment, three sheets are superposed and discharged, and if the last sheet is to be discharged alone, the last four sheets are discharged two by two, which is one smaller than the number of sheets to be superposed each time, the present invention is not limited to this, but in the case where the last sheet is to be discharged alone, as shown in FIG. 16E, the number of sheets to be stacked at last may be one greater than the number of sheet to be superposed d each time. In this case, the number of times the aligning device 140 is operated is increased, and hence the durability thereof is reduced, but the number of sheets to be superposed each time is reduced to realize more stable alignment.

A description will now be given of a third embodiment of the present invention.

According to the present embodiment, at least two sheets are always superposed and discharged onto the stacking device, and if the last sheet has to be discharged alone onto the stacking device depending on the number of sheets included in a bundle, the last sheet is discharged after being retained for a predetermined period of time so as to provide constant extended sheet conveyance time intervals. As a result, it is possible to realize a sheet processing apparatus with high alignment latitude and an image forming apparatus provided with the sheet processing apparatus.

The internal construction of the image forming apparatus, the entire construction of the sheet processing apparatus, the constructions of the rocking guide and the processing tray, the construction of the processing tray and the aligning wall moving mechanism, and the construction of the controller for the image forming apparatus according to the present embodiment are identical with those (FIGS. 1 to 5) of the above described first embodiment, and therefore description thereof is omitted.

Further, the operation mode determining process, the sort process, the staple sort process, a non-sort sheet sequence, the sort sheet sequence, the sheet property determining process, the bundle discharge operation determining process, and the stapling process according to the present embodiment are identical with those (FIG. 6, and FIGS. 8 to 15) of the above described first embodiment, and therefore description thereof is omitted. The third embodiment differs from the first embodiment only in its non-sort process.

Figure 17:
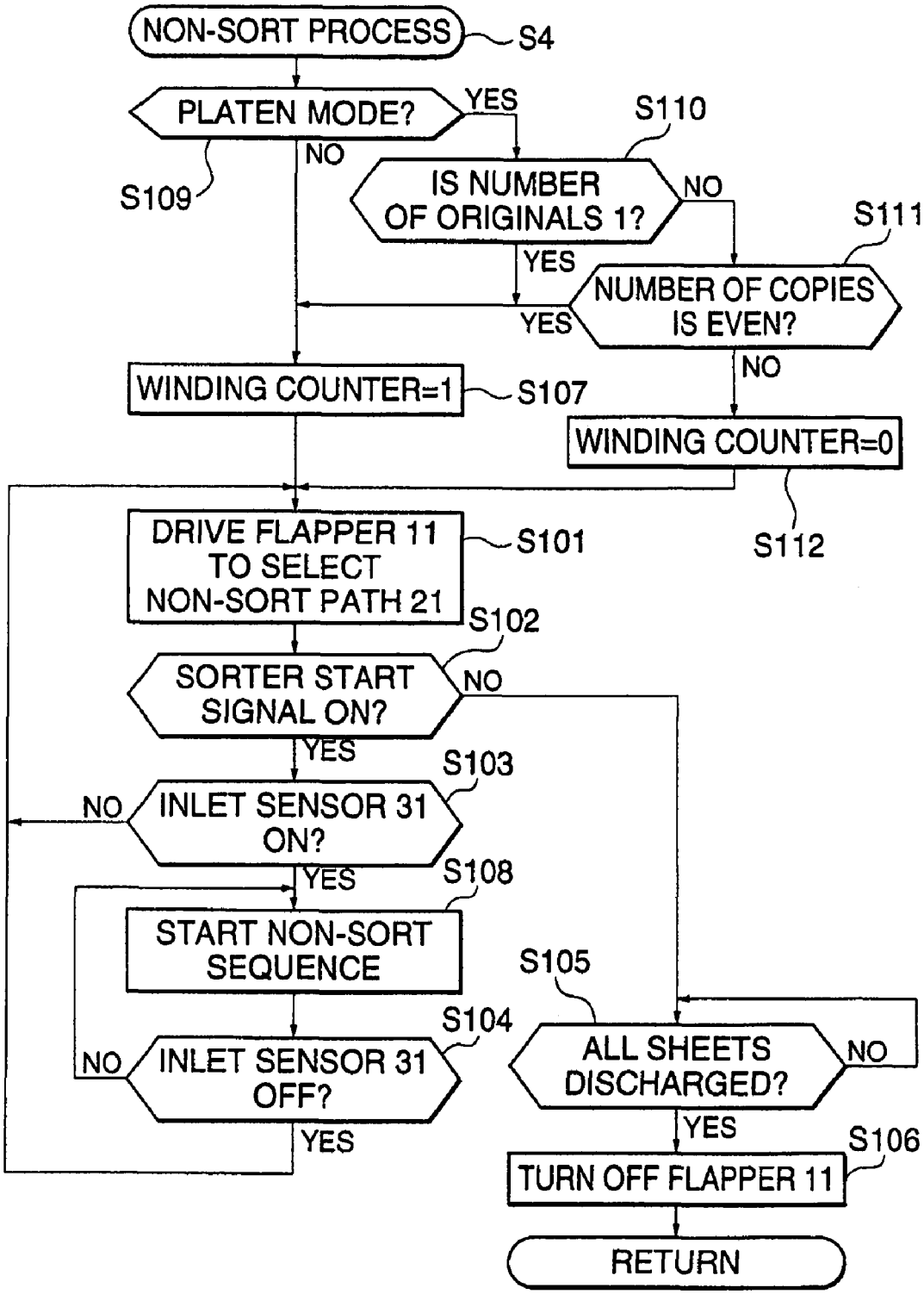
FIG. 17 is a flow chart showing another example of the non-sort process carried out by the image forming apparatus in FIG. 1.

FIG. 17 is a flow chart showing the non-sort process carried out by the image forming apparatus. The non-sort process is executed in the step S4 in FIG. 6 if it is determined in the step S3 in FIG. 6 according to the first embodiment that the operation mode is the non-sort mode.

In the non-sort process, whether or not the copy mode is a platen mode in which an original is placed on the platen glass 906 and held in place by a platen to make copying without using the automatic original feeder 500 is determined so as to determine whether or not the first sheet is to be wound around the buffer roller 5 (step S109). If it is determined that the copy mode is not the platen mode, the winding counter is set to 1 (step S107). On the other hand, if it is determined that the copy mode is the platen mode, the winding counter is set to 0 (step S112) if the number of originals is 1 and the number of copies to be produced is odd (steps S110 and S111), and otherwise, the winding counter is set to 1 (step S107).

By this processing, in the case where the number of sheets to be conveyed to the sheet processing apparatus 1 is known in advance, it is determined whether the first sheet is to be wound around the buffer roller 5 or not. This prevents the last sheet from being discharged alone onto the tray, and surely provide sheet conveyance time intervals required for discharge control of sheets to be discharged onto the tray without deteriorating the productivity of the image forming apparatus.

Next, to guide a sheet P to the sample tray 201, the switching flapper 11 is operated to select the non-sort path 21 (step S101). It is then determined whether the finisher start signal has been generated or not (step S102), and if the finisher start signal has been generated, the sheet P discharged from the image forming apparatus 300 is conveyed into the sheet path in the sheet processing apparatus 1. It is then awaited that the leading end of the sheet P conveyed by the inlet motor M1 is detected by the inlet sensor 31 disposed in the sheet path and the inlet sensor 31 is turned on (step S103).

In response to the turning-on of the inlet sensor 31, the non-sort sheet sequence is started (step S108). It is then awaited that the trailing end of the sheet P being conveyed leaves the inlet sensor 31 so that the inlet sensor 31 is turned off (step S104). In response to the turning-off of the inlet sensor 31, the process returns to the step S102, where the same processing is repeated as in the case where the finisher start signal has been generated. On the other hand, in the case where the finisher start signal has ceased to be generated, it is awaited that all of sheets have been discharged onto the sample tray 201 (step S105), and when all the sheets have been completely discharged, the switching flapper 11 is stopped (step S106) to terminate the non-sort process.

Figure 18A:
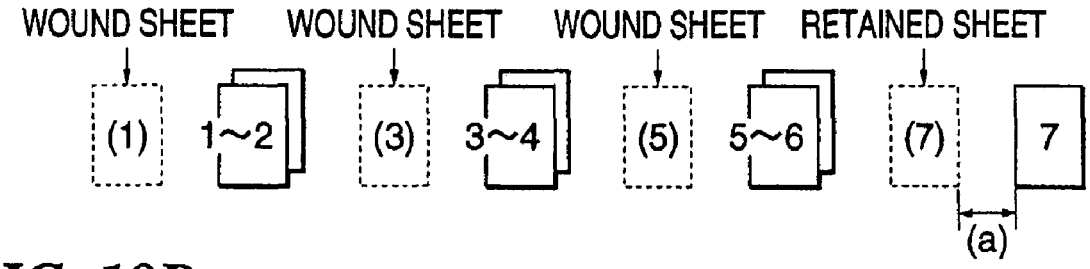
FIGS. 18A to 18D are views useful in explaining concrete examples of a winding process carried out by the image forming apparatus in FIG. 1.

A description will now be given of concrete examples of winding performed by the image forming apparatus based on the sheet property determining process. FIGS. 18A to 18D are views useful in explaining the concrete examples of the winding process carried out by the image forming apparatus. FIG. 18A shows the case where seven-page originals are subjected to processing in a copy mode in which the automatic original feeder 500 is used to read originals. In this case, regarding the first sheet of a job, the winding counter is set to 1, and the sheet is designated as a sheet to be wound and wound around the buffer roller 5. The first sheet and the succeeding second sheet are superposed and discharged together onto the sample tray 201. Similarly, the third and fourth sheets are superposed and discharged together onto the sample tray 201, and the fifth and sixth sheets are superposed and discharged onto the sample tray 201. Since the succeeding seventh sheet is the last one, it is wound around the buffer roller 5 and discharged onto the sample tray 201 after being retained for a predetermined period of time on the buffer roller 5.

As described above, in the case where the last sheet has to be discharged alone onto the sample tray 201, it is retained by a retaining device (buffer roller 5) in the sheet processing apparatus 1 and then discharged onto a stacking device (sample tray 201). This enables sheet alignment to be completed within sheet conveyance time intervals without deteriorating the productivity of the image forming apparatus main body.

It should be noted that, if the last sheet is not retained, the last sheet reaches the sample tray 201 while a sheet immediately preceding the last sheet is being controlled to be discharged, and they collide with each other to cause sheet jam.

Figure 18B:
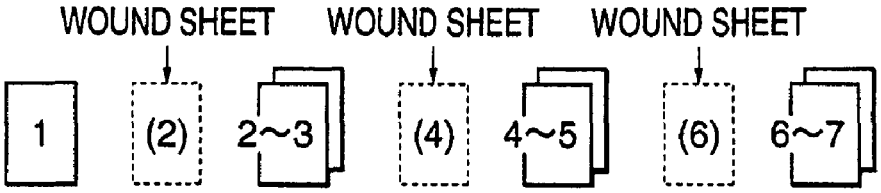

FIG. 18B shows the case where seven-page originals are subjected to processing in the copy mode in which the automatic original feeder 500 is not used in reading originals (i.e., the above described platen mode). Since seven is an odd number, the winding counter is set to 0 for the first sheet, and the first sheet is discharged alone onto the sample tray 201. The succeeding second sheet is designated as a sheet to be wound, and is wound around the buffer roller 5, and the second sheet and the succeeding third sheet are superposed and discharged onto the sample tray 201. Similarly, the fourth and fifth sheets are superposed and discharged onto the sample tray 201, and the sixth and seventh sheets are superposed and discharged onto the sample tray 201.

Figure 18C:
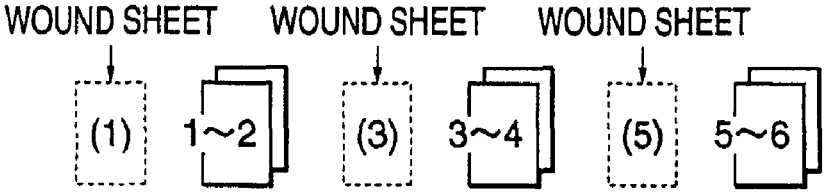

FIG. 18C shows the case where six-page originals are subjected to processing in the copy mode in which the automatic original feeder 500 is not used for reading originals (i.e., the above described platen mode). Since six is an even number, the winding counter is set to 1 for the first sheet, and the first sheet is designated as a sheet to be wound and is wound around the buffer roller 5. The first sheet and the succeeding second sheet are superposed and discharged together onto the sample tray 201. Similarly, the third and fourth sheets are superposed and discharged onto the sample tray 201, and the fifth and sixth sheets are superposed and discharged onto the sample tray 201.

As described above, in the case where the number of sheets to be conveyed to the sheet processing apparatus is known in advance, controlling the winding of the first sheet according to the number of sheets eliminates the necessity of retaining the last one sheet by the retaining device (the buffer roller 5), and reduces the period of time (a) [ms] required for processing in FIG. 18A, which corresponds to the period of time in which a sheet is retained.

As described above, according to the third embodiment, in a sheet discharging process carried out by the sheet processing apparatus attached to the image forming apparatus, at least two sheets are superposed by the buffer roller 5 and then discharged together onto the stack tray 200 or the sample tray 201 via the processing tray 130, and if the last sheet has to be discharged alone onto the stack tray 200 or the sample tray 201 via the processing tray 130, the last sheet is retained by the buffer roller 5 and then discharged onto the stack tray 200 or the sample tray 201 via the processing tray 130. This enables sheet alignment to be completed within sheet conveyance time intervals without deteriorating the productivity of the image forming apparatus main body 300.

Further, at least tow sheets are superposed by the buffer roller 5 and then discharged onto the stack tray 200 or the sample tray 201 via the processing tray 130, and if the last sheet has to be discharged alone onto the stack tray 200 or the sample tray 201 via the processing tray 130, the last sheet is retained on the buffer roller 5 and then discharged onto the stack tray 200 or the sample tray 201. This makes it possible to provide control to reduce the sheet conveying speed within sheet conveyance time intervals without deteriorating the productivity of the image forming apparatus main body 300.

Further, if the total number of sheets to be conveyed to the sheet processing apparatus 1 from the image forming apparatus main body 300 is known in advance, controlling the winding of the first sheet according to the total number of sheets eliminates the necessity of retaining the last one sheet on the buffer roller 5 and hence can reduce the period of time required for processing, by the period of time in which the last sheet is retained.

The above described second embodiment encompasses a sheet processing apparatus that causes a sheet superposing device to superpose sheets such that conveyance time intervals between sheets being conveyed onto a processing tray are wider than conveyance time intervals between sheets being received by the sheet processing apparatus in the case where an alignment operation is carried out by an aligning device.

A description will now be given of a fourth embodiment of the present invention.

Although in the above described third embodiment, two sheets are always superposed and discharged, the present invention is not limited to this. For example, in the case where B sheets can be always superposed and discharged onto and stacked on the tray, B sheets are always superposed and discharged, and if the last sheet has to be discharged alone, it is discharged onto the tray after being retained by the retaining device (the buffer roller 5).

Further, although in the above described third embodiment, in the case where the total number of sheets to be conveyed to the sheet processing apparatus is known in advance, whether or not the first sheet is to be wound around the buffer roller 5 is determined according to whether the total number of the sheets is odd or even, the present invention is not limited to this. For example, the number of sheets to be superposed and discharged first may be controlled, so that the last sheet can be prevented from being discharged alone.

Figure 18D:
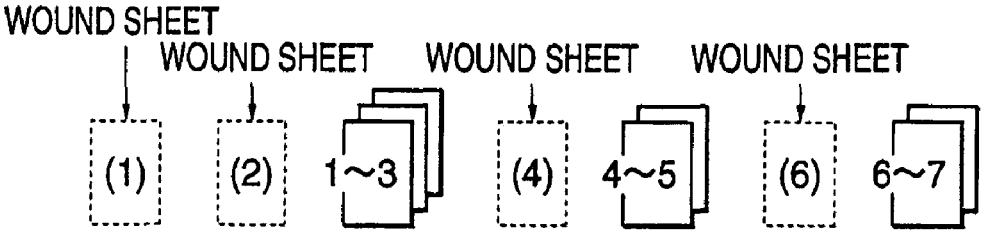

Further, although in the above described third embodiment, in the case where the total number of sheets to be conveyed to the sheet processing apparatus is known in advance, whether or not the first sheet is to be wound around the buffer roller 5 is determined according to whether the total number of the sheets is odd or even, the present invention is not limited to this. For example, the number of sheets to be superposed and discharged first may be controlled according to the total number of the sheets as shown in FIG. 18D, so that the last sheet can be prevented from being discharged alone.

Although in the above described first through fourth embodiments, the present invention is applied to the image forming apparatus (copying machine) as a single apparatus provided with the sheet processing apparatus according to the present invention, the present invention is not limited to this, but the present invention may be applied to a system in which the image forming apparatus (copying machine) having the sheet processing apparatus according to the present invention and information processing apparatuses such as a personal computer are connected to each other such that they may communicate with each other.

Further, although in the above described first through fourth embodiments, the image forming apparatus (copying machine) carries out image formation based on electrophotography, the present invention is not limited to this, but the image forming apparatus may carry out image formation by another method such as ink-jet printing.

Further, although in the first through fourth embodiments, the sheet processing apparatus according to the present invention is attached to a copying machine, the present invention is not limited to this, but the sheet processing apparatus according to the present invention may be attached to a printer, a facsimile, or a multi-function machine.

Further, the present invention may either be applied to a system composed of a plurality of apparatuses or to a single apparatus.

It is to be understood that the object of the present invention may also be accomplished by supplying a system or an apparatus with a storage medium in which a program code of software which realizes the functions of any of the above described embodiments is stored, and causing a computer (or CPU or MPU) of the system or apparatus to read out and execute the program code stored in the storage medium.

In this case, the program code itself read from the storage medium realizes the functions of any of the above described embodiments, and hence the program code and a storage medium on which the program code is stored constitute the present invention.

The storage medium for supplying the program code is not limited to a ROM, and a floppy (registered trademark) disk, a hard disk, an optical disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a download carried out via a network may be used.

Further, it is to be understood that the functions of any of the above described embodiments may be accomplished not only by executing the program code read out by a computer, but also by causing an OS (operating system) or the like which operates on the computer to perform a part or all of the actual operations based on instructions of the program code.

Further, it is to be understood that the functions of any of the above described embodiment thereof may be accomplished by writing the program code read out from the storage medium into a memory provided in an expansion board inserted into a computer or a memory provided in an expansion unit connected to the computer and then causing a CPU or the like provided in the expansion board or the expansion unit to perform a part or all of the actual operations based on instructions of the program code.

As described above, since the discharging device discharges a plurality of sheets onto the stacking device after the sheet superposing device superposes them irrespective of a sheet bundle as a unit to be processed by the sheet processing apparatus, it is possible to provide control to reduce the sheet discharging speed in the discharging device even if intervals of conveyance of sheets being conveyed to the sheet processing apparatus (sheet conveyance time intervals) are short, and to reduce the size of the driving system for the aligning device, since the aligning device should not necessarily be capable of performing each alignment at a high speed. Further, it is possible to reduce the number of times of operation to be performed by the aligning device, and improves the durability of the driving system for the aligning device.

Further, since whether the last sheet of a sheet bundle is to be retained or not is determined according to whether there is any preceding sheet in the sheet superposing device, it is possible to provide control to reduce the sheet discharging speed in the discharging device and to reduce the size of the driving system for the aligning device since the aligning device does not have to be capable of performing each alignment at a high speed. Further, it is possible to reduce the number of times of operation to be performed by the aligning device, and to improve the durability of the driving system for the aligning device.

Further, since the sheet superposing operation by the sheet superposing device is controlled according to the number of sheets constituting a sheet bundle, it is possible to reduce the size of the driving system for the aligning device since the aligning device should not be capable of performing each alignment at a high speed. Further, it is possible to reduce the number of times of operation to be performed by the aligning device, and to improve the durability of the driving 10 system for the aligning device.

What is claimed is:

1. A sheet processing apparatus, which is connected to an image forming apparatus that forms an image according to an image forming job, comprising:

a sheet superposing device that temporarily retains at least one sheet of a plurality of sheets being conveyed and superposes the retained at least one sheet and a succeeding sheet;

a stacking device that stacks thereon the sheets conveyed from said sheet superposing device;

an aligning device that aligns the sheets stacked in said stacking device;

a discharged sheet tray onto which the sheets aligned by said aligning device are discharged in a sheet bundle; and a controller that causes said sheet superposing device to perform a sheet superposing operation, wherein said aligning device aligns sheets stacked in said stacking device in units of at least two sheets, even if the sheets stacked in said stacking device are first discharged to said discharged sheet tray as a first sheet bundle for the image forming job, and wherein said controller determines which of the sheets are to be retained in said sheet superposing device, based on the number of sheets to be stacked as the first sheet bundle in said stacking device, so that said sheet superposing device does not convey the sheets to said stacking device in unit of one sheet, even if the sheets to be stacked in said stacking device are stacked as said first sheet bundle.

2. A sheet processing apparatus according to claim 1, wherein said controller causes said sheet superposing device to superpose sheets of the sheet bundle at least two by two each time, until a sheet preceding by N sheets, where N represents a number of sheets in the sheet bundle, reaches said sheet superposing device.

3. A sheet processing apparatus according to claim 2, wherein:

said controller is operable when a preceding sheet exists in said sheet superposing device at a time point the sheet preceding by N sheets of the sheet bundle reaches said sheet superposing device, for causing said sheet superposing device to superpose the sheet preceding by N sheets and the preceding sheet existing in said sheet superposing device; and said controller is operable when no preceding sheet exists in said sheet superposing device at a time point the sheet preceding by N sheets of the sheet bundle reaches said sheet superposing device, for causing said sheet superposing device to superpose the sheet preceding by N sheets and a succeeding sheet.

4. A sheet processing apparatus according to claim 3, wherein N is equal to any numerical value within a range from 2 to a value which is one smaller than a maximum number of sheets that can be superposed by said sheet superposing device.

5. A sheet processing apparatus according to claim 1, wherein said controller causes said sheet superposing device to always superpose the sheet immediately preceding the last sheet and the last sheet.

6. A sheet processing apparatus according to claim 5, wherein the number of sheets to be superposed each time is one smaller than a maximum number of sheets to be superposed by said sheet superposing device.

7. An image forming apparatus that forms an image according to an image forming job provided with a sheet processing apparatus comprising:

a sheet superposing device that temporarily retains at least one sheet of a plurality of sheets being conveyed and superposes the retained at least one sheet and a succeeding sheet;

a stacking device that stacks thereon the sheets conveyed from said sheet superposing device;

an aligning device that aligns the sheets stacked in said stacking device;

a discharged sheet tray onto which the sheets aligned by said aligning device are discharged in a sheet bundle; and a controller that causes said sheet superposing device to perform a sheet superposing operation, wherein said aligning device aligns sheets stacked in said stacking device in units of at least two sheets, even if the sheets stacked in said stacking device are first discharged to said discharged sheet tray as a first sheet bundle for the image forming job, and wherein said controller determines which of the sheets are to be retained in said sheet superposing device, based on the number of sheets to be stacked as the first sheet bundle in said stacking device, so that said sheet superposing device does not convey the sheets to said stacking device in unit of one sheet, even if the sheets to be stacked in said stacking device are stacked as said first sheet bundle.

8. A sheet processing apparatus according to claim 1, wherein the sheet superposing device repeatedly superposes sheets that constitute part of the sheet bundle and reach the sheet superposing device in succession.

9. A sheet processing apparatus according to claim 1, wherein the aligning device repeatedly aligns sheets that constitute part of the sheet bundle and are stacked in succession in the stacking device.

* * * * *